US005522356A

United States Patent [19]

Palmer

[11] Patent Number: 5,522,356

[45] Date of Patent: Jun. 4, 1996

[54] METHOD AND APPARATUS FOR TRANSFERRING HEAT ENERGY FROM ENGINE HOUSING TO EXPANSION FLUID EMPLOYED IN CONTINUOUS COMBUSTION, PINNED VANE TYPE, INTEGRATED ROTARY COMPRESSOR-EXPANDER ENGINE SYSTEM

[75] Inventor: William R. Palmer, Melbourne, Fla.

[73] Assignee: Spread Spectrum, Melbourne, Fla.

[21] Appl. No.: 315,103

[22] Filed: Sep. 29, 1994

Related U.S. Application Data

[63] Continuation-in-part of Ser. No. 940,446, Sep. 4, 1992, Pat. No. 5,427,068.

[51] Int. Cl.[6] ..... F02B 53/00

[52] U.S. Cl. ..... 123/236; 123/204; 60/39.55; 60/39.6

[58] Field of Search ..... 123/204, 236; 60/39.05, 39.54, 39.55, 39.6

[56] References Cited

U.S. PATENT DOCUMENTS

| | | | |
|---|---|---|---|
| 3,038,308 | 6/1962 | Fuller | 60/39.55 |
| 3,747,573 | 7/1973 | Foster | 418/260 |
| 4,519,206 | 5/1985 | van Michaels | 60/39.54 |

FOREIGN PATENT DOCUMENTS

| | | | |
|---|---|---|---|
| 1382603 | 2/1975 | United Kingdom | 123/204 |

*Primary Examiner*—Charles Freay
*Attorney, Agent, or Firm*—Charles E. Wands

[57] ABSTRACT

A continuous combustion, pinned vane type, positive displacement, rotary compressor and expander engine system comprises a compressor which outputs compressed air, a combustor which effects continuous combustion of a combustion gas mixture containing fuel and the compressed air and produces a combustion gas output. An expander is coupled to receive a mixture of combustion gas and an expansion fluid as an expandable working gas. The expander expands the expandable working gas and performs work to cause rotation of an engine output shaft. Each the compressor and the expander comprises a respective pinned vane type, positive displacement, rotary device. The engine system further includes an expansion fluid flow path having an input port to which the expansion fluid is supplied, and an output port coupled to combine the expansion fluid with the combustion gas as the expandable working gas. The expansion fluid flow path is in thermal communication with the expander housing such that there is a thermal energy transfer from the housing to the expansion fluid, thereby increasing the thermal energy of the expansion fluid to the extent where a phase transformation takes place from the liquid phase to the gaseous phase. In the gaseous phase the expansion fluid is combined with the combustion gas to form the expandable working gas.

63 Claims, 13 Drawing Sheets

METHOD AND APPARATUS FOR TRANSFERRING HEAT ENERGY FROM ENGINE HOUSING TO EXPANSION FLUID EMPLOYED IN CONTINUOUS COMBUSTION, PINNED VANE TYPE, INTEGRATED ROTARY COMPRESSOR-EXPANDER ENGINE SYSTEM

CROSS-REFERENCE TO RELATED APPLICATIONS

The present application is a continuation-in-part of my application Ser. No. 940,446 (hereinafter referenced as the '446 application), filed Sep. 4, 1992, and issued as U.S. Pat. No. 5,427,068 on Jun. 27, 1995, entitled: "Rotary Compressor and Engine System," assigned to the assignee of the present application, and the disclosure of which is herein incorporated.

FIELD OF THE INVENTION

The present invention relates in general to rotary machines and, more particularly, to a scheme for transferring energy derived from the heat of the engine housing of a continuous combustion, pinned vane type, positive displacement, rotary compressor and expander engine system, to a thermal energy transfer medium, such as an expansion fluid, circulating in a thermal energy medium subsystem incorporated into the engine system, so that to the extent that a phase change occurs, changing the expansion fluid from a liquid state to a gaseous state, the energy density of the expansion fluid is increased and the performance of the rotary engine system is enhanced.

BACKGROUND OF THE INVENTION

In a conventional reciprocating internal combustion engine, which typically operates at a relatively low engine housing temperatures (e.g. on the order of 180° F.) and has acceptable low speed torque and throttling characteristics, heat is removed from the engine housing by means of a water jacket (for water cooled engines) or by metal cooling fins (for air cooled engines). Because approximately fifty percent of the heat energy created by combustion of the fuel is lost in the form of housing heat and is wasted (expelled to the atmosphere without performing mechanical work), the thermodynamic system efficiency of such a conventional engine is inherently low.

To improve efficiency of a typical reciprocating internal combustion engine in an ideal fashion, one might simply remove the radiator from the engine. The engine would then be allowed to operate at an elevated housing temperature of 350° F. (current temperatures are about 180° F., as noted above). At this point, steam at a pressure of about 120 psi, created in the engine housing (water jacket), could be routed into the cylinder head. Then, during the very short fraction of a second just after ignition (at the top of the power stroke) the elevated temperature (350° F.) steam would be injected into the cylinder head. The combustion process, provided it is not extinguished by the steam (which is the fundamental problem), would heat the combined mixture of fuel, air and steam to about 1500° F. This would provide a significant increase in the percentage of work that could then be performed on the piston during the expansion process. Namely, with the engine housing operating at the elevated temperature, pre-heated steam would be superheated by the constituents of combustion, and the total constituent working fluid would expand producing work on the piston. Unfortunately, in a conventional reciprocating internal combustion engine, this wasted engine casing heat energy is not easily recaptured to improve the engine's efficiency.

For one thing, the engine housing is not permitted to reach a temperature sufficiently hot to provide adequate potential energy to the heat transfer fluid (water as an example). Secondly, it is extremely difficult to inject the water back into the engine cylinder following the ignition and explosion portion of the cycle, but prior to the expansion portion of the power stroke. Internal combustion type engine systems which have incorporated water injection approaches have resulted in poor reliability based on the difficulties associated with timing the injection and explosion processes.

A gas turbine engine, on the other hand, which employs continuous combustion, typically does not use radiators or cooling fins. Gas turbine engines are not positive displacement engines; hence they do not have rotating blades in contact with the surface of the housing containing them. Since the rotating blades of a gas turbine engine do not come in contact with the stationary parts of the engine, the operating temperatures (typically 1300° F. to 1800° F.) do not cause wear problems.

Such high operating temperatures would appear to make a gas turbine engine a good candidate for improved efficiency compared to a reciprocating internal combustion engine. Indeed some gas turbines do inject water into the combustion gas stream in order to increase the power and efficiency. However, a fundamental limitation of a gas turbine engine is the fact that a gas turbine engine customarily has poor performance for low speed, high torque applications, which require throttling; adequate performance of a gas turbine engine is achieved only at very high engine speeds.

SUMMARY OF THE INVENTION

In accordance with the present invention, the above-described drawbacks of conventional reciprocating internal combustion engines and gas turbine engines are successfully remedied by means of a new and improved continuous combustion, positive displacement, pinned vane engine system, which enjoys performance characteristics that are similar to or better than a conventional reciprocating internal combustion engine, (i.e. torque at low speeds and good throttle characteristics), while incorporating the use of engine waste heat by operating at higher engine housing temperatures, so as to increase system thermodynamic efficiency.

Pursuant to the present invention, the goal of providing heat transfer from components of the engine housing to the constituent working fluid is carried out in a continuous combustion, positive displacement, pinned vane compressor and expander heat engine system, preferably of the type described in the above-referenced '446 application. As described in that application, the compressor and the expander of the pinned vane rotary engine system may employ substantially the same rotary device configuration.

Such a rotary device configuration is diagrammatically shown in FIG. 1 as having a housing 11 containing an inner hub 13 and an outer hub assembly 15. The inner hub 13 rotates about a central first axis 21 of an interior chamber 23 of the housing 11, while the outer hub assembly 15 rotates about a second axis 25 that is offset from the central first axis 21. The inner hub 13 is located within the outer hub 15, and is mechanically linked with the outer hub 15 by way of a timing gear arrangement 26 and 28, an end sectional view of which is shown in FIG. 1A.

A plurality of vanes or blades 31 are pivotally attached or pinned through respective axes 38 passing through one end of each of the blades at the inner hub, so that the blades may rotate about these respective axes. The blades or vanes pass through slots 35 in the outer hub assembly 15 which are formed between respective blade spreader elements 36. Each blade spreader element 36 engages respective blades 31 at different locations and thereby different angles, because of the offset location of the inner hub 13 relative to the axis 25 of the outer hub assembly 15.

Each blade 31 has a first radially interior portion 32, which engages the inner hub 13, and a second, radially outer portion which passes through the outer hub assembly 15 to the interior surface 12 of the housing 11. Rotation of the inner hub 13 about the first central axis 21 drives the interior portion 32 of each blade 31 about the central axis 21. High pressure working fluid gas from the inlet to the housing 11 applies a force on the outer portion 34 of each blade 31. The force on the blade outer portion 34 is transferred to the outer hub assembly 15 by means of roller elements 15A. The force on the roller elements 15A drives the outer hub assembly 15 about the second axis 25.

The gearing linkage 26, 28 between the inner hub 13 and the outer hub assembly 15 is such that, as the blades 31 rotate during rotation of the inner hub about the first axis and the outer hub assembly about the second axis, the blades 31 depart from extending radially about the first axis 21. This departure of the blades 31 from the radial direction forms a plurality of relatively airtight compartments 37 between the interior surface 12 of the housing 11, the outer hub assembly 15, and respective pairs of blades 31. The volume of the compartments 37 varies as a function of rotative position around the first central axis 21, so that the rotary device may be employed as either a compressor device or an expander device.

As diagrammatically illustrated in FIG. 2, in a combined engine system, both a compressor 41 and an expander 43 are employed in combination with a combustor 45. In the compressor 41 of the engine system, the engine's input shaft 42, to which the inner hub of the compressor is connected, is driven. This driving of the compressor's inner hub causes its outer hub assembly to be rotated by the gearing linkage between the two, so that the blades are rotated to compress a combustion gas (e.g. air) which is applied to a compression gas inlet, shown at 46. The compressed gas is then supplied to a compressed gas outlet port 48 for application to an air inlet port 51 of a downstream continuous combustion system 45. A combustible fuel is supplied to a fuel inlet port 53 of combustor 45, where it is mixed with the compressed air and ignited. The combusted gas is then ported via outlet port 55 as an expandable working gas to the inlet port 57 of the expander 43. The combusted working fluid may be augmented by the introduction of steam to realize an expandable working gas mixture of steam and combusted gas.

In the expander 43 of the engine system, the expandable gas from the upstream combustor 45 that has been applied to inlet port 57 of the expander housing pushes against the expander's rotary blades which, in turn, push upon the outer hub assembly of the expander 43, causing the expander's outer hub assembly to rotate. As the outer hub assembly of the expander 43 rotates, the gearing arrangement between the outer hub and the expander's inner hub causes the inner hub to rotate, so that the blades travel rotationally around the interior of the expander housing. Then, as the expander blades rotate, successive compartments of the expander containing the working gas increase in volume and thereby allow the gas to expand, and eventually exit an exhaust port 56. During rotation of the expander's outer hub assembly and, consequently, its mutually geared inner hub, rotation of the inner hub drives an output shaft 58, producing work out for driving a load.

It should be noted that the work output shaft 58 of the expander 43 can be an extension of the work input shaft 42 of the compressor 41. Also, the outer hub assembly of the expander can be an extension of the compressor's outer hub assembly, thereby forming a continuous system requiring only one set of timing gears.

As explained above, according to the present invention, the continuous combustion, positive displacement, pinned vane compressor and expander rotary device described in my '446 application is augmented by the incorporation of a thermal energy transfer medium sub-system, in particular an expansion fluid sub-system, which is thermally coupled with the expander housing, either directly, or via an intermediate heat exchanger. This thermal energy transfer medium sub-system is operative to absorb thermal energy from the expander housing, which simultaneously cools the housing and increases potential energy of the thermal energy transfer medium. Using an expansion fluid as the thermal energy transfer medium allows the expansion fluid to be employed as a constituent component of the working gas that is supplied to the expander, in particular to be combined with the combusted gas produced by the combustor, resulting in a working gas that is delivered from the combustor to the expander. As will be described, the addition of this thermal energy transfer expansion fluid sub-system results in a new and improved engine system that does not suffer from the above-described inherent shortcomings of conventional engine systems.

In particular, the thermal energy transfer medium-augmented continuous combustion, positive displacement, pinned vane compressor and expander heat engine configuration according to the present invention is capable of operating at temperatures considerably higher than a conventional internal combustion engine, due to the fact that the cooling effect of the expansion fluid reduces part stresses and sealing requirements relative to those encountered in a conventional internal combustion engine. As a non-limiting example, incorporating a thermal energy transfer medium sub-system in accordance with the present invention enables engine case temperatures to be in the 500° F. temperature range.

In addition, the continuous combustion aspect of the system allows for steam (at a pressure in a range on the order of 120–350 psi, for example) to be injected at or just beyond the flame front of combustion. Advantageously, this feature of the present invention eliminates the requirement for critical timing injection hardware and insures that the injection of steam will not extinguish or impede the combustion process.

The engine configuration according to the present invention is formed as an integrated unit in which the fundamental rotary device architecture of each of the compressor and expansion fluid sub-system-augmented expander of the engine essentially corresponds to that of the rotary device, described above. The compressor and the expansion fluid-augmented expander share a common rotating shaft. A combustor is interposed between the compressor and the expander of the engine system. Also employed are a starter/generator and a timing gear assembly which are housed in an integrated assembly with the compressor, combustor and expander.

The rotary device of the compressor takes in fresh air, compresses that air and supplies the compressed air to the combustor. In the combustor, this compressed air is mixed with a combustible fluid, combusted, and then output as an expandable working gas to the expander, wherein the working gas is expanded and used to perform work and rotate the engine output shaft.

For this purpose, the compressor has an outer housing which is configured to be integral with a compressible fluid (e.g. air) inlet passageway through which ambient air is drawn for application to an interior compression chamber. The air inlet passageway of the compressor housing extends along an outer solid wall of the compression chamber housing starting from a first air inlet port. This process allows the cooler ambient air to remove heat from the compressor housing. The compressor housing air inlet port, containing an air filter, also communicates with a conduit coupled to the exhaust gas heat exchanger. The exhaust gas heat exchanger is also coupled to the exhaust manifold from the expander. A second air inlet port engages the heat exchanger. The heat exchanger has a first ambient air inlet port, allowing ambient air passage through the heat exchanger. This air passage is then coupled to the compressor inlet air manifold. The exhaust gas leaving the expander exhaust manifold enters the heat exchanger to effect a convective thermal transfer between the exhaust gas and the incoming ambient air, thereby preheating the intake air to the compressor and removing heat energy from the exhaust gas system.

A portion of the compressor's interior chamber has a plurality of apertures through which preheated air compressed by the compressor is ported into an inlet passageway of the combustor. Thus, pre-heated ambient air that has entered the interior chamber of the compressor is compressed during rotation of the inner hub and blades of the compressor about the central axis of its interior chamber, and associated rotation of the outer hub assembly, and then supplied as pressurized pre-heated air to the compressed air inlet passageway of the combustor.

Similar to the compressor, the expander has an outer housing which is configured to be integral with and form a wall portion of a thermal energy transfer medium flow path, in particular a heat absorbing fluid passageway. In a first embodiment of the expander, this wall portion of the fluid passageway extends to a coupling port to which an outlet port fitting of the combustor is joined. The fluid passageway is sized and configured to allow a thermal energy absorbing medium to circulate in conductive, heat-absorbing relationship with the body of expander housing, in particular, the walls of the expander housing that surround and define the confines of its interior expansion chamber, where the hot working gas from the combustor is expanded.

This thermal energy absorbing medium may be an expansion fluid, such as water, that fills and is circulated directly through the fluid passageway, so that it is heated by the expansion chamber wall. During the heat absorption process the expansion fluid changes from a liquid phase to a gaseous phase and is then supplied as steam (a working gas) to the inlet of the expander, where it is combined with the combusted gas from the combustor, to yield a working expansion gas mixture at the inlet of the expander chamber. In this embodiment, the thermal conductivity of the expander housing wall provides a thermal flow path from the interior of the expansion chamber in which the hot working gas is expanded to the heat absorption medium of the fluid passageway. As expansion fluid flows through the expansion fluid passageway it draws heat away from the expansion chamber walls and increases its thermal energy potential. Where water is the expansion fluid, the thermal energy transfer effectively converts the water in the expansion fluid passageway from a liquid state to a gaseous state (e.g. steam), where the latent heat of vaporization consumes a prescribed quantity of thermal energy per unit volume of expansion fluid (per pound of water).

The expansion fluid passageway has a plurality of apertures adjacent to and communicating with a mixing inlet throat portion of the expander. Within this throat portion, the superheated steam from the expansion fluid passageway mixes with combustion gases from the combustor and the resulting combined working gas enters the expansion inlet at a substantially elevated temperature (e.g. on the order of 1100° F.) subsequent to the working gas expansion process (rotation of the blades and hub assemblies), the interior chamber has a further wall portion, which is spaced apart from the throat portion and contains a plurality of apertures, which provide exhaust ports into the expander's exhaust manifold, which is in fluid communication with the exchanger used to preheat the intake air to the compressor, as noted above. The exhaust manifold of the expander contains an expansion fluid heat exchanger unit, that provides a preheating of the expansion fluid prior to its being injected into the expansion fluid passageway, by convectively transferring heat energy in the exhaust gas from the expander into the expansion fluid being supplied to the expansion fluid passageway. For an exhaust manifold temperature on the order of 375° F., the temperature of water supplied as an expansion fluid may be preheated from a nominal room input temperature on the order of 80° F. to a value on the order of 180° F. as it is injected at the inlet port of the expansion fluid passageway.

Then, as the expansion fluid travels through the fluid passageway surrounding the interior chamber of the expander housing, the expander housing is cooled by the heat exchange between its outer wall and the expansion fluid, which operates to elevate the temperature of the expansion fluid (to a steam temperature on the order of 350° F., for example) and maintain the temperature of the housing at a relatively steady value (on the order of 500° F., for example).

Integrated with the compressor and expander is a combustor, having an expansion gas inlet port joined to a combusted gas outlet port. The combustor includes an outer housing wall portion and an interior flame cage, each being integrally formed with the outlet port and defining a compressed air inlet passageway, therebetween. The combustor flame cage has a plurality of openings through which compressed preheated air supplied by the compressor enters the flame cage and is mixed with combustion fuel injected by way of a fuel nozzle. In the flame cage, the fuel/compressed air mixture is ignited to produce continuous combustion, producing an extremely hot (e.g. on the order of 2400° F.) combustion core. At a downstream end region of the combustion zone adjacent to the outlet port, the temperature of the combustion gas is still considerably elevated (e.g. on the order of 1800° F.), so that it has substantial thermal energy to be applied to the expansion fluid that is injected into the throat portion (expansion gas inlet) of the expander.

As the expansion fluid (e.g. superheated steam) enters the inlet throat of the expander, the superheated steam mixes with combustion gases from the combustor and the combined working gas is injected at a now reduced combustion gas temperature (e.g. on the order of 1100° F.) into the interior chamber of the expander. Once it has entered the interior chamber of the expander, the working gas mixture expands, causing rotation of the blades of the expander. During this expansion process, the temperature of the working gas in the interior chamber of the expander drops (e.g. to about 475° F.), as work is performed and the engine's output shaft is driven. The expanded working fluid then exits to the exhaust manifold at a temperature of about 375° F.

In accordance with further embodiments of the invention, the expansion fluid may flow through a heat transfer path that is in direct contact with the engine housing, as in the first embodiment, or it may flow through a secondary heat exchanger system, wherein the secondary heat exchanger system is coupled with a heating fluid flow path that is in direct contact with the engine housing.

More specifically, pursuant to a first modification of the heat transfer medium flow path, a section of meandering, thermally conductive conduit extends through the heating fluid passageway of the expander housing. This section of expansion fluid conduit passes through a bore in the expander housing and terminates at an expansion fluid (e.g. steam) injection port within that portion of the combustor adjacent to its outlet port. In this second embodiment, expansion fluid flows through the meandering tubing installed in the heating fluid passageway, rather than through the confines of the passageway itself.

In a further modification of the expander, the expansion fluid does not flow through the heating fluid passageway either directly, as in the first embodiment, or indirectly through the meandering conduit of the second embodiment. Instead, a separate dual flow path finned heat exchanger module is coupled in the fluid flow output path of the exhaust manifold heat exchanger unit. This additional heat exchanger module has a first input port which is coupled between the exhaust manifold heat exchanger unit and a first output port to which an expansion fluid supply conduit is coupled. The heat exchanger module is also connected to a heating fluid return line which is ported to one end of the expander fluid passageway. A second end of the fluid passageway is ported to a heating fluid pump, which is coupled to the heat exchanger module. The heating fluid is pumped in a closed system through the heating fluid passageway and a return conduit through the heat exchanger. The expansion fluid, on the other hand, is supplied through the manifold heat exchanger and then through heat exchanger, wherein it is converted to steam by the transfer of thermal energy from the heating fluid being circulated through the heating fluid passageway along the engine housing wall and through the heat exchanger.

In either of these alternative thermal energy transfer approaches, where the expansion fluid does not flow directly in contact with the interior of the passageway through the expander housing, the expansion fluid passageway may be filled with a high temperature, non-freezing heating fluid. The expansion fluid may then be plumbed through the heating fluid-filled passageway directly, or it may be routed through the secondary heat exchanger, through which both the heating fluid and the expansion fluid pass to provide thermal transfer.

The combustor may also be modified to incorporate a steam supply line, which is routed through the compressed air supply passageway surrounding the exterior perimeter of the combustor flame cage. In this modified configuration of the combustor, rather than provide apertures in the wall of the expansion fluid passageway into the inlet throat of the expander, a bore is formed through the outer housing wall and ported to one end of a steam conduit line. A second end of the steam conduit line is ported through a bore in the outer housing wall of the combustor, to a conformal section of steam tubing, which is ported to a steam injection zone at the downstream end of the combustion zone adjacent to outlet port fitting. The steam tubing section is used to cool the very hot section of the combustor, while absorbing additional potential energy prior to being mixed with the constituent of combustion gases. In this configuration, the steam temperature is increased to a value on the order of 700° F. prior to mixing with the combustion gas.

In a further modification of the combustor, steam is mixed directly with the compressed feed air from the compressor upstream of the combustion zone. For this purpose, a steam supply line is routed around the exterior perimeter of the combustor housing. Again, rather than provide apertures in the wall of the expansion fluid passageway into the inlet throat to the expander, a bore is formed through the outer housing wall and ported to one end of a steam supply line. A second end of the steam supply line is ported through a bore in the outer housing wall of the combustor, upstream of the flame cage, so that the steam mixes with the compressed air in the compressed air passageway, prior to being injected into the flame cage. In this configuration, the combined gas cools the combustor and mixes with the fuel to form products of combustion.

DETAILED DESCRIPTION

Figure 3:
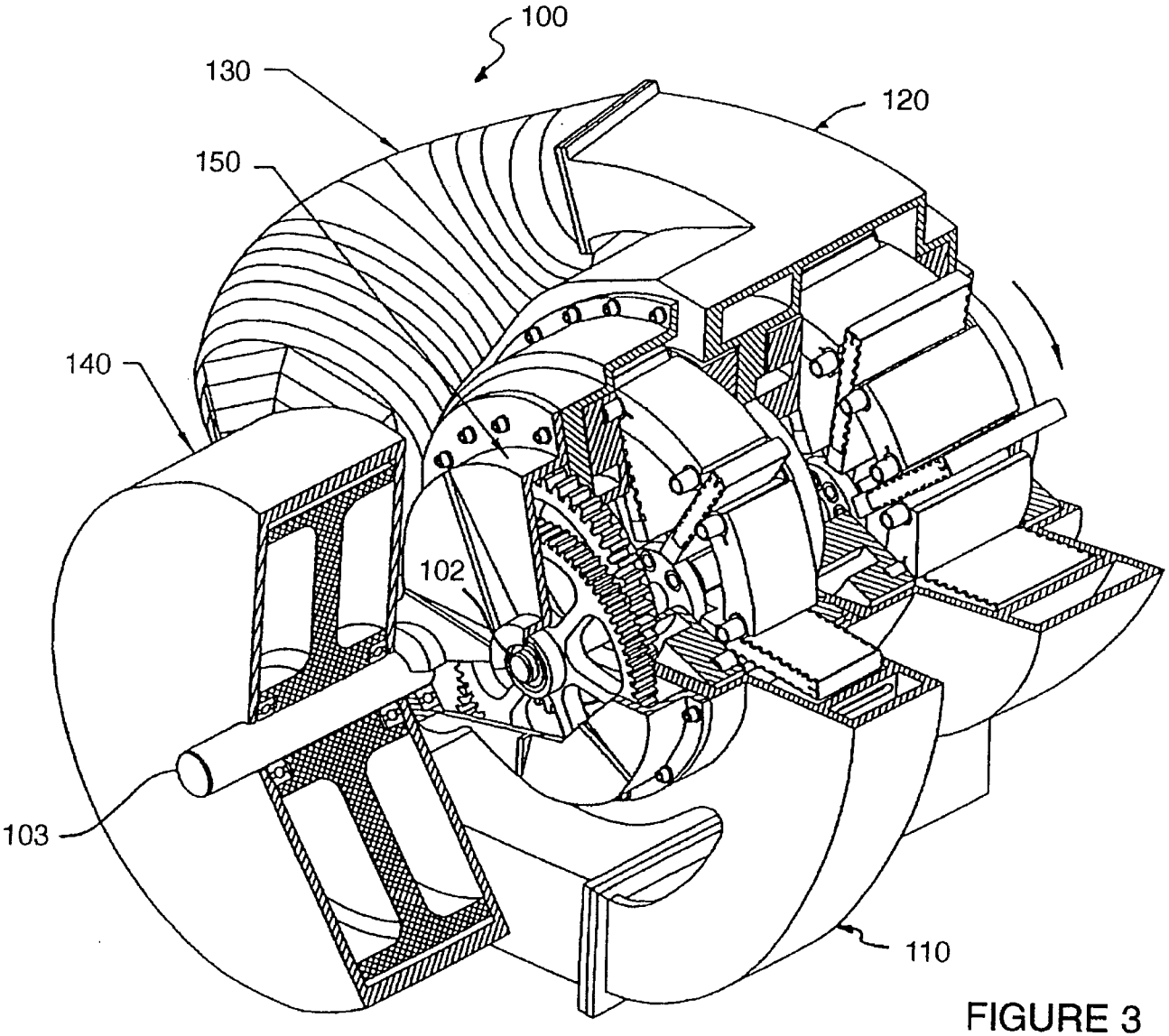
FIG. 3 diagrammatically illustrates a perspective view of a continuous combustion, positive displacement, pinned vane engine system that is augmented with a thermal energy transfer expansion fluid architecture in accordance with an embodiment of the present invention, using a rotary device of the type described in the above-referenced '446 application and being assembled as an integrated compressor-combustor-expander unit.
Figure 4:
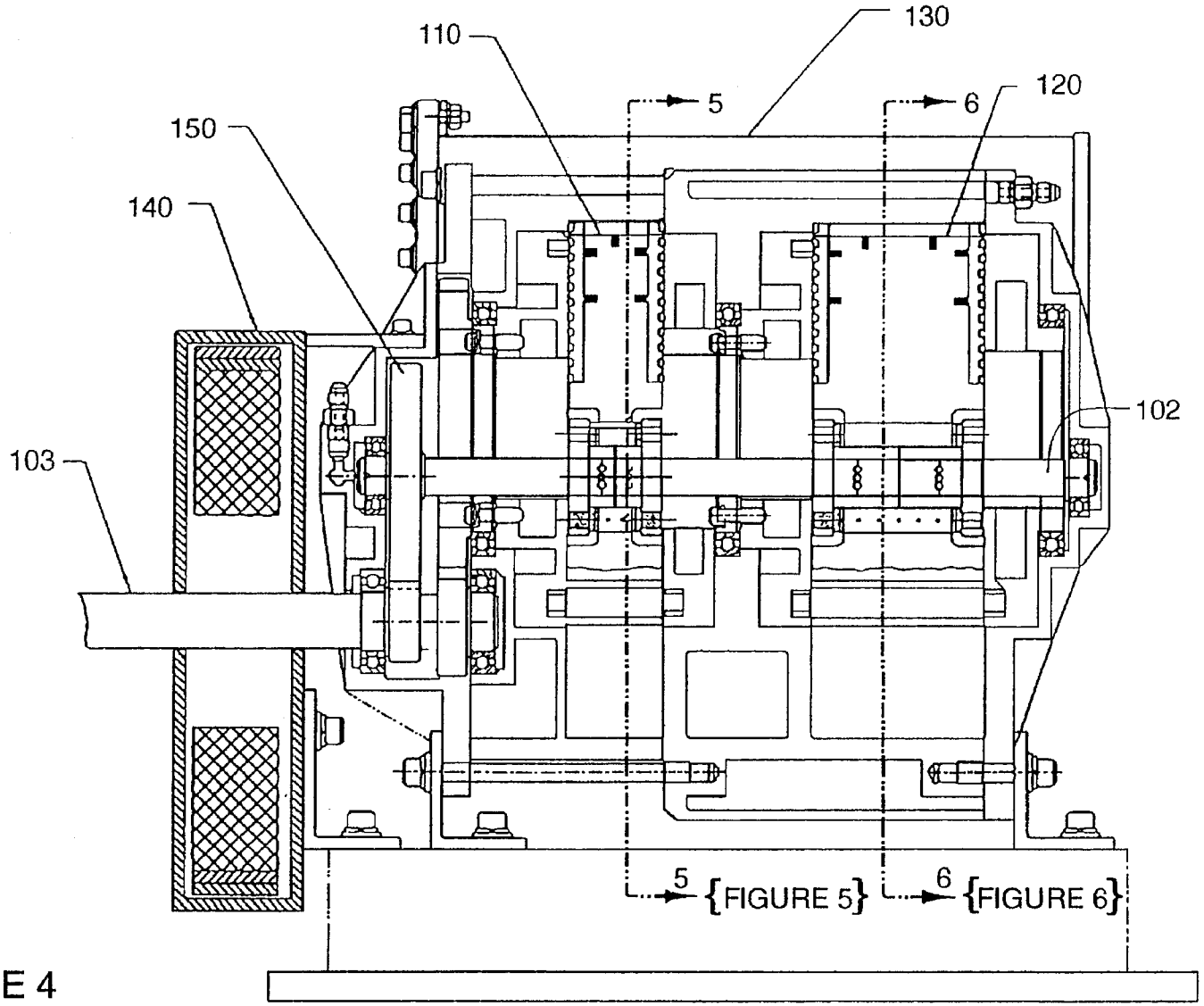
FIG. 4 is a diagrammatic cross-sectional illustration of the engine system of FIG. 3.
Figure 5:
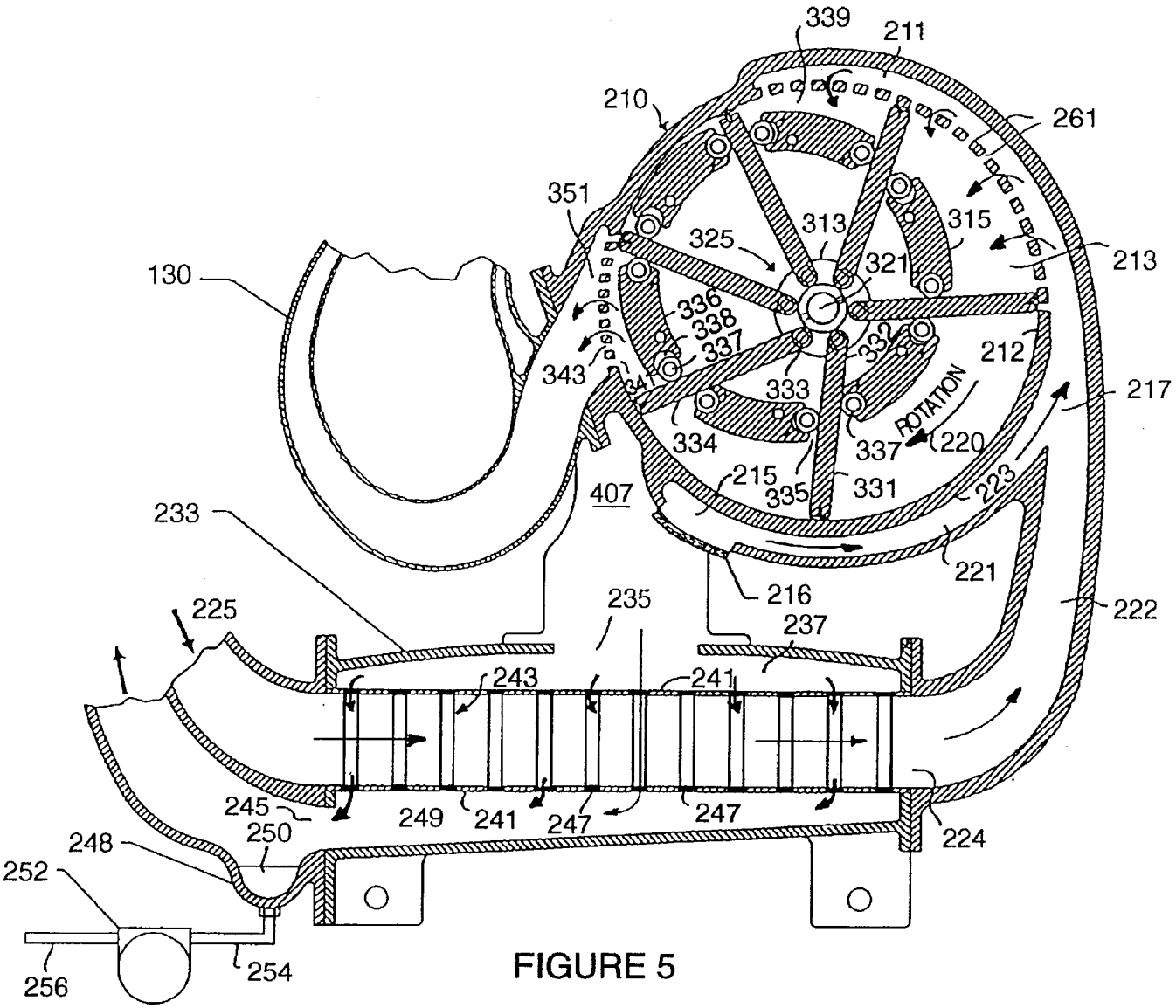
FIG. 5 is a sectional view of the compressor of the engine system taken along lines 5—5 of FIG. 4.
Figure 6:
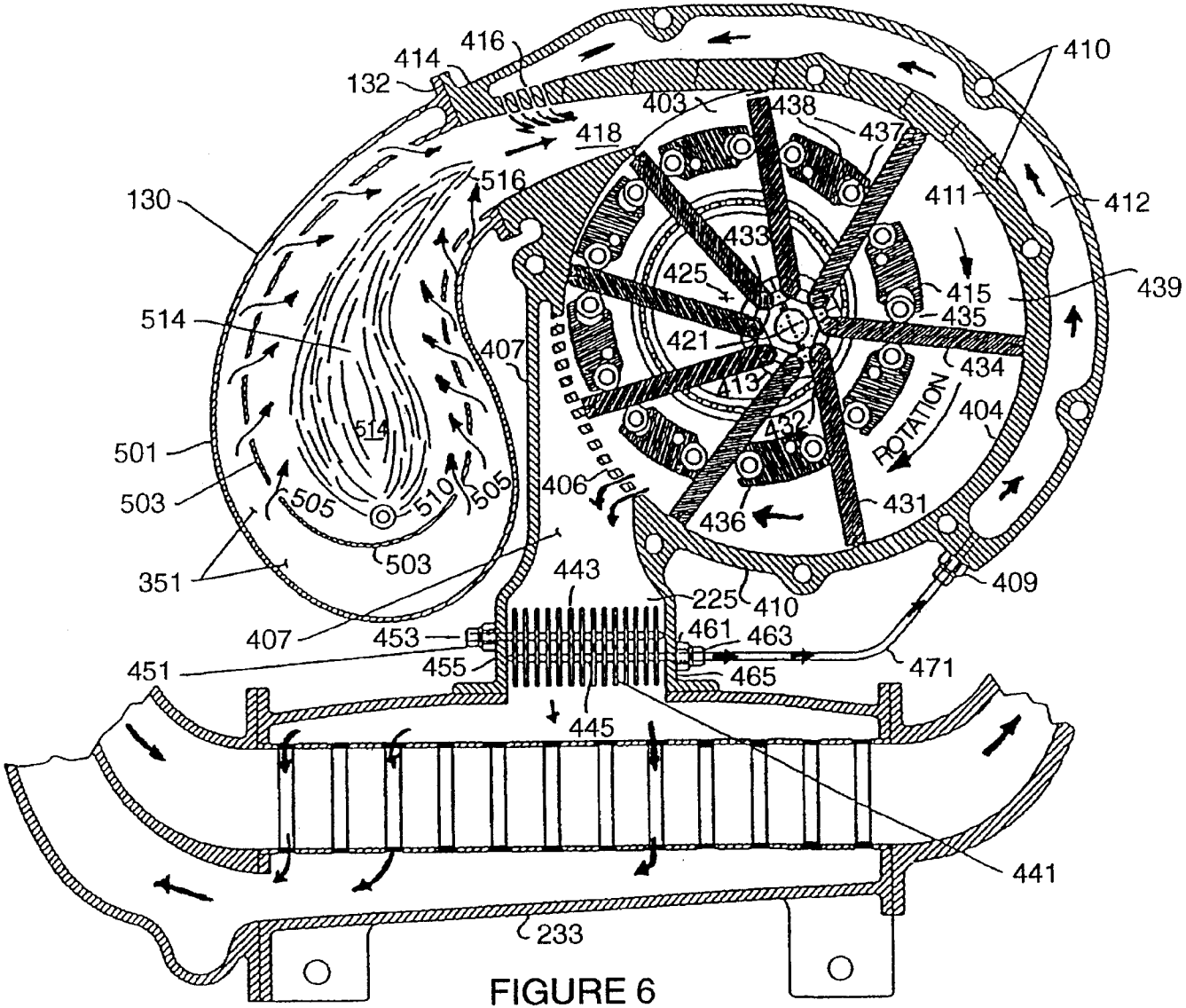
FIG. 6 is a sectional view of the expander of the engine system taken along lines 6—6 of FIG. 4.

Attention is initially directed to FIGS. 3–6, in which FIG. 3 diagrammatically illustrates, in perspective, a combined engine system employing a thermal energy transfer medium-containing architecture in accordance with an embodiment of the present invention, using a rotary device of the type described in the above-referenced '446 application and being assembled as an integrated compressor-combustor-expander unit, FIG. 4 being a diagrammatic cross-sectional illustration of the engine system of FIG. 3, FIG. 5 being a sectional view of the compressor of the engine system taken along lines 5—5 of FIG. 4, and FIG. 6 being a sectional view of the expander of the engine system taken along lines 6—6 of FIG. 4.

More particularly, as shown in FIGS. 3 and 4, the engine system is formed as an integrated unit 100, in which a compressor 110 and an expander 120 share a common rotating shaft 102. A combustor 130 is interposed between the compressor 110 and the expander 120 of the engine system. Also diagrammatically shown are a starter/generator 140 and a timing gear assembly 150 mounted together with the engine housing to complete the overall assembly.

Figure 2:
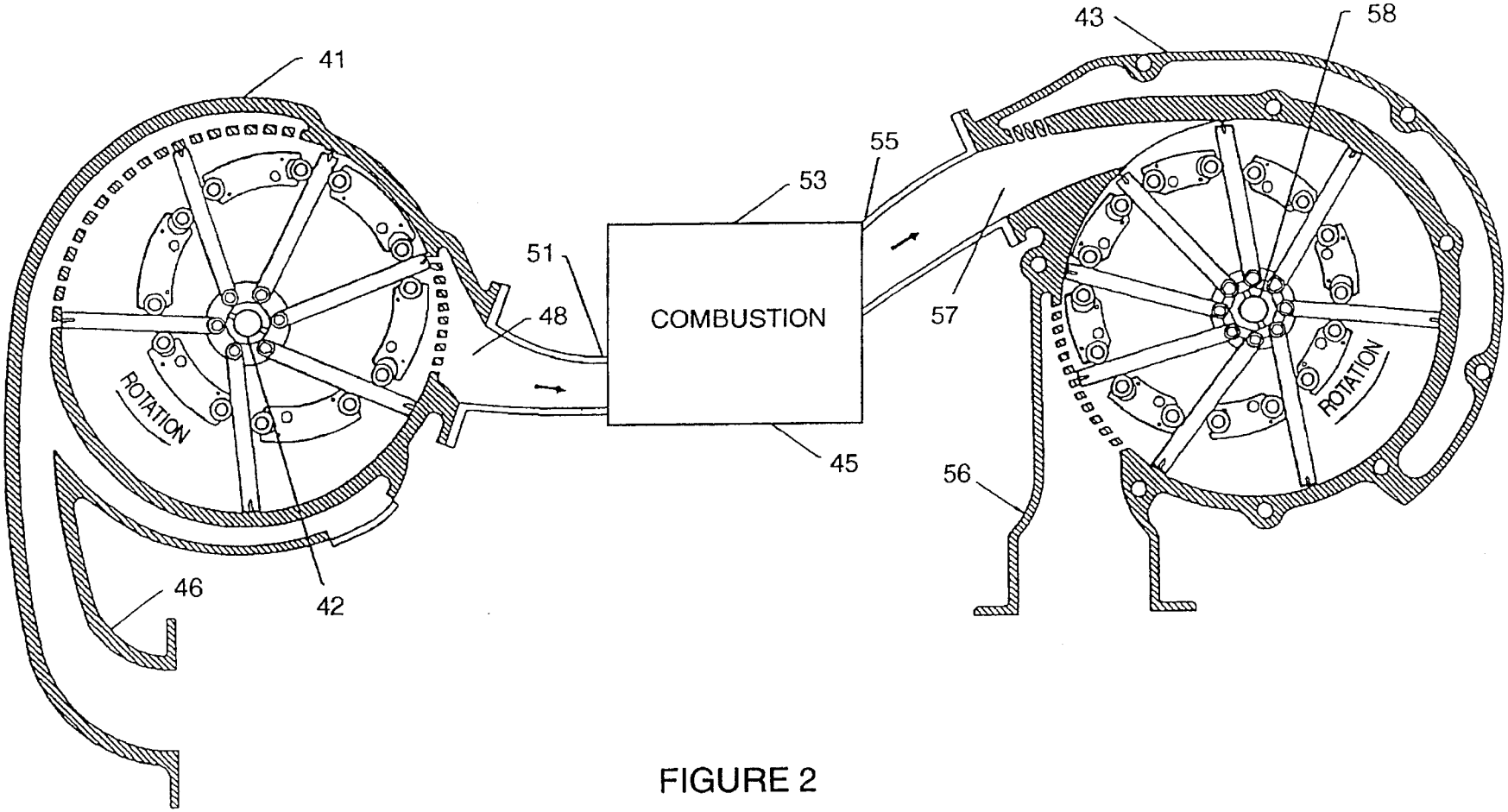
FIG. 2 diagrammatically illustrates a continuous combustion engine system, in which a compressor and an expander of the type shown in FIG. 1 are employed in combination with a combustor.

As explained previously with reference to the system of FIG. 2, the compressor 110 takes in fresh air, which is compressed and supplied to combustor 130, where the compressed air is mixed with a combustible fluid, combusted, and then output as an expandable working gas to the expander 120. In the expander 120, the working gas is expanded and used to perform work and rotate shaft 103.

In accordance with the present invention, the system is modified to incorporate a heat exchanging, thermal energy transfer medium, flow structure through which a thermal energy transfer medium (e.g. an expansion fluid such as water) is coupled in thermal communication with the housing of the expander, so as to significantly improve the thermal energy transfer process within the engine system. The architectures of each of the compressor and expander are described individually below.

More specifically, the structure of the compressor 110 is diagrammatically illustrated in FIG. 5 as comprising an outer thermally conductive housing 210, which is configured to be integral with a compressible fluid inlet passageway 211 through which a compressible fluid (e.g. air) is drawn for application to an interior chamber 213, disposed within outer housing 210. Fluid inlet passageway 211 has a first portion 221 which extends along an outer solid wall region 223 of interior chamber 213 from a first air inlet port 215 to an intersection region 217 of passageway 211. An ambient air inlet port 225 is provided at the inlet port of heat exchanger 233. Preheated inlet air leaving the heat exchanger at 224 combines with the air entering from inlet port 215. An air filter element 216 is installed at both air inlet ports 215 and 225.

Air inlet passageway 211 has a second portion 222, which extends from intersection region 217 with first portion 221 along the outer solid wall region 223 of interior chamber 213 to preheated air leaving the heat exchanger 233 at the port 224. Heat exchanger 233 is preferably configured in the manner described in my copending patent application Ser. No. 08/315,100, filed coincident herewith, entitled: "Method and Apparatus for Using Exhaust Gas Condenser to Reclaim and Filter Expansion Fluid Which Has Been Mixed with Combustion Gas in A Combined Cycle Heat Engine Expansion Process," assigned to the assignee of the present application, and the disclosure of which is herein incorporated.

As described in that application and as shown diagrammatically in FIG. 5, heat exchanger 233 has an exhaust gas inlet port 235 that communicates with the expander exhaust manifold 407 of the expander 120, and opens into an interior chamber 237, in which a heat exchanger element 241 is installed. Heat exchanger element 241 comprises a plurality of thermally conductive tubes 243 that extend between the upper portion 237 and the lower portion 249 through openings 247 that extend vertically over the length of the heat exchanger element, and allow exhaust gas supplied from the inlet at 235 to pass therethrough and be vented to a second outlet port 245. The ambient inlet air travels from port 225 to port 224 of heat exchange element 241.

As the exhaust gas from the expander exhaust manifold 231 passes through thermal exchange tubes 243 of the heat exchange element 241, there is a convective thermal transfer between the exhaust gas and the thermally conductive material of the heat exchange element 241, in which the heat from the exhaust gas is transferred to the heat exchanger 233. In turn, there is a further convective thermal transfer between the heat exchange element 241 and the ambient air being supplied from air inlet port 225, in which the heat from the heat exchanger is transferred to the ambient air being draw in to the compressor and passing through heat exchange element 241 into passageway 211, thereby increasing the temperature of the intake air.

The convective thermal transfer between the exhaust gas and the thermally conductive material of the heat exchange element 241, causes condensation of the expansion fluid (water droplets in the case of using water/steam as the expansion fluid) on the interior of the heat exchanger 233 as the exhaust gas cools. This water condensation is collected by a condensation accumulator or sump 248 installed at a downstream region of heat exchanger 233 adjacent to second outlet port 249. A condensation pump 252 is coupled to a condensation removal line 254, that is ported to the bottom of the sump 248, so that accumulated water condensation 250 may be removed via a feed water supply line 256.

As described in the above-referenced coincidently filed application, the feed water supply line 256 is coupled in an expansion fluid recirculation path to the expansion fluid inlet port of the expander, thereby enabling a percentage of the expansion fluid to be reclaimed, so as to reduce the total or net utilization of water from an associated expansion fluid storage facility.

Figure 1:
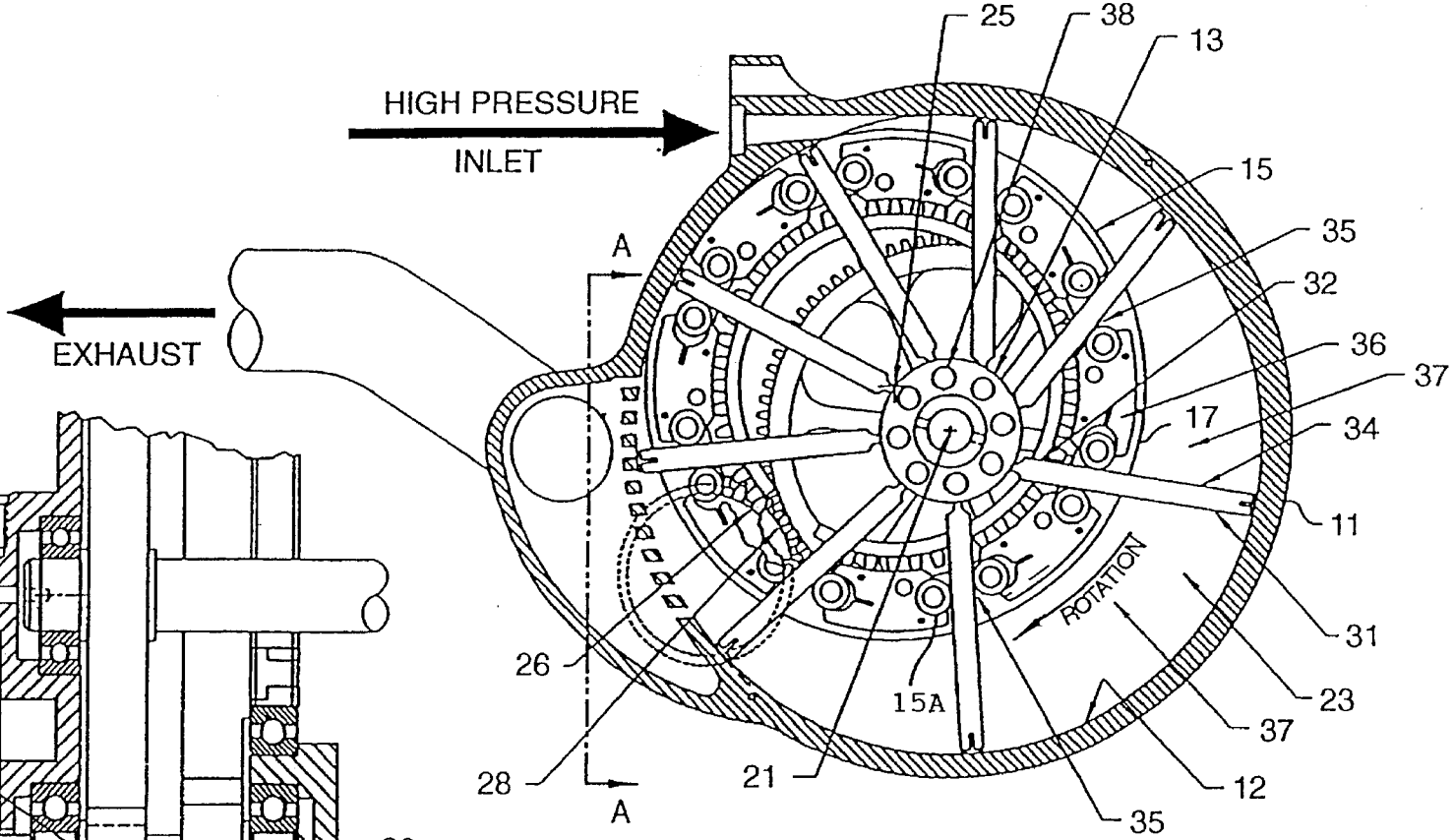
FIG. 1 diagrammatically illustrates a positive displacement, pinned vane rotary device configuration of the type described in the above-referenced '446 application.
Figure 1A:
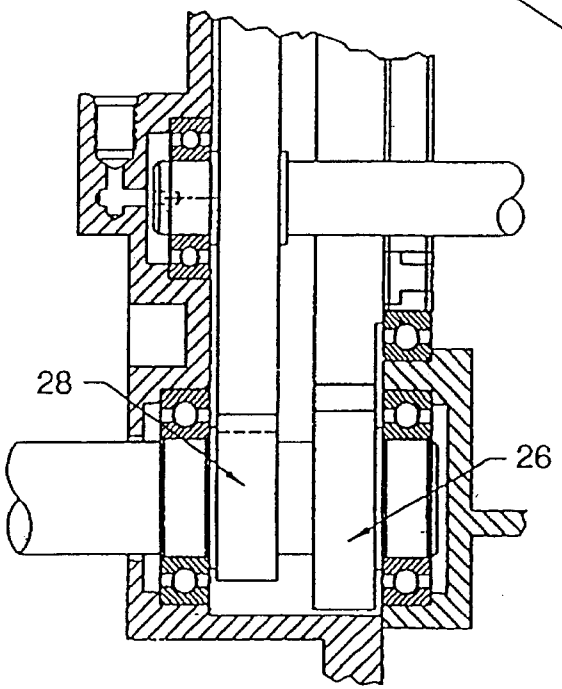
FIG. 1A diagrammatically illustrates an end sectional view of the timing gear portion of the rotary device shown in FIG. 1, taken along lines A—A.

The first portion 221 of fluid inlet passageway 211, which extends along outer solid wall region 223 of interior chamber 213 has one or more apertures 261 distributed along a circumferential sub-portion of interior chamber 213, so that pre-heated ambient air may enter the interior chamber 213. As in the rotary device configuration of FIG. 1, described above, the compressor of FIG. 5 has an inner hub 313 and an outer hub assembly 315. The inner hub 313 rotates about a central first axis 321 of interior chamber 213, while the outer hub assembly 315 rotates about a second axis 325 that is offset from the central first axis 321. The inner hub 313 is mechanically linked with the outer hub assembly 315 by way of a gear arrangement (not shown in FIG. 5).

A plurality of blades (vanes) 331 are pivotally attached through respective axes 333 passing through a first, radially interior end 332 of each of the blades 331 at the inner hub 313, so that the blades 331 may rotate about these respective axes 333. Second, radially outer portions 334 of the blades pass through slots 335 in the outer hub assembly 315, which are formed between respective blade spreader elements 336. Each blade spreader element 336 has a cylindrical roller element 337 that is accommodated in a slot 338 in the spreader element. Positioning pin elements (not shown) are captured in the outer hub assembly 315 at the ends of the spreader element slot 338, so that the cylindrical roller element 337 is properly located against a side surface of a blade, to ensure a pivotal seal at each slot 338. Thus, the roller elements 337 allow respective blades 331 to be sealingly engaged at different locations and thereby different angles, in accordance with the offset location of the inner hub 313 relative to the central axis 321.

Such a sealing arrangement is preferably configured in the manner described in co-pending application Ser. No. 08/315,095, entitled: "Blade Sealing Arrangement for Continuous Combustion, Positive Displacement, Combined Cycle, Pinned Vane Rotary Compressor and Expander Engine System," filed coincident herewith, assigned to the assignee of the present application, and the disclosure of which is incorporated herein.

The first radially interior portion 332 of a respective blade 331 engages the inner hub 313, such that rotation of the inner hub 313 about the first central axis 321 drives this first radially interior portion 332 of each blade about the central axis 321. With the second, radially outer portion 334 of each blade 331 passing through the outer hub assembly 315 to the interior surface 212 of the outer housing 210, rotation of the outer hub assembly 315 about the second axis 325 drives the second, radially outer portion 334 of each blade 331 about the second axis 325.

As noted above, with reference to FIG. 1, with inner hub 313 and outer hub assembly 315 being coupled through a mutual gearing arrangement, then as the blades 331 rotate during rotation of the inner hub about central axis 321 and the outer hub assembly 315 about the second axis 325, the blades 331 depart from extending radially about the central axis 321. This departure of the blades 331 from the radial direction forms a plurality of different volume, relatively airtight compartments 339, with the volume of each compartment varying as a function of rotative position around the central axis 321.

A further sub-portion 341 of interior chamber 213, which is spaced apart from the circumferential sub-portion containing apertures 261 that communicate with fluid inlet passageway 211, has a plurality of apertures 343, through which compressed air, produced by the compressor, is ported into an inlet passageway 351 of combustor 130. Thus, pre-heated ambient air that has entered the interior chamber 213 of the compressor 110 through apertures 261 is compressed during rotation (as shown by clockwise arrow 220 in FIG. 5) of the inner hub 313 about central axis 321 of interior chamber 213, and associated rotation of the outer hub assembly 315 rotates about axis 325, and supplied as pressurized pre-heated air to the compressed air inlet passageway 351 of combustor 130. The integrated structure of the expander 120 and combustor 130 of the engine system to which the compressor structure of FIG. 5 is coupled is diagrammatically illustrated in FIG. 6.

Specifically, similar to compressor 110, the expander 120 comprises an outer housing 410, which is configured to be integral with and form a wall portion 411 of a thermal transfer medium passageway 412, through which an expansion fluid, such as water, may flow. Wall portion 411 of expansion fluid passageway 412 extends to a coupling port 414 to which an outlet port fitting 132 of combustor 130 is joined. Expansion fluid passageway 412 serves to provide a circulation path for an expansion fluid, such as water, in contact with the thermally conductive wall portion 411 of the expander housing. Through flow contact with wall portion 411, the temperature of a thermal transfer/expansion fluid (e.g. water), that has been injected at a fluid inlet port 409, is elevated by thermal flow through the wall 411 of the expander housing 410. As will be described, as an expansion fluid flows through passageway 412 its potential energy is raised significantly by drawing heat away from the expander housing, using the latent heat of vaporization to convert the liquid phase of the expansion fluid (e.g. water) into a gaseous phase (e.g. steam), which has a much higher potential energy.

Adjacent to coupling port 414, wall portion 411 of heating fluid, expansion fluid passageway 412 has a plurality of apertures 416 that communicate with a mixing inlet throat portion 418 of the expander 120. Within this throat portion 418, steam injected from expansion fluid passageway 412 mixes with combustion gases from the combustor 130 and the combined working gas is injected at a substantially elevated temperature (e.g. on the order of 1100° F.) into an interior chamber 403 of the expander 120.

Adjacent to coupling port 414, wall portion 411 of heating fluid, expansion fluid passageway 412 has a plurality of apertures 416 that communicate with a mixing inlet throat portion 418 of the expander 120. Within this throat portion 418, steam injected from expansion fluid passageway 412 mixes with combustion gases from the combustor 130 and the combined working gas is injected at a substantially elevated temperature (e.g. on the order of 1100° F.) into an interior chamber 403 of the expander 120.

The rotary device configuration of the expander, like that of the compressor described above, has an inner hub 413 and an outer hub assembly 415. The inner hub 413 rotates about a central first axis 421 of interior chamber 403, while the outer hub assembly 415 rotates about a second axis 425 that is offset from the central first axis 421. The inner hub 413 is mechanically linked with the outer hub assembly 415 by way of a gear arrangement (not shown in FIG. 6).

A plurality of blades 431 are pivotally attached through respective axes 433 passing through a first, radially interior end 432 of each of the blades 431 at the inner hub 413, so that the blades 431 may rotate about these respective axes 433. Second, radially outer portions of the blades pass through slots 435 in the outer hub assembly 415, which are formed between respective blade spreader elements 436. Each blade spreader element 436 has a cylindrical roller element 437 that is accommodated in a slot 438 in the spreader element. Positioning pin elements (not shown) are captured in the outer hub assembly 415 at ends of the spreader slot 438, so that the cylindrical roller element 437 is properly positioned against a side surface of a blade, thereby providing a pivotal seal at each slot 438. Thus, the roller elements 437 allow respective blades 431 to be sealingly engaged at different locations and thereby different angles, in accordance with the offset location of the inner hub 413 relative to the central axis 421.

As in the compressor, the sealing arrangement for the blades 431 is preferably configured in the manner described in the above-referenced, coincidently filed application Ser. No. 08/315,095, entitled: "Blade Sealing Arrangement for Continuous Combustion, Positive Displacement, Combined Cycle, Pinned Vane Rotary Compressor and Expander Engine System."

The first radially interior portion 432 of a blade engages the inner hub 413, such that rotation of the inner hub 413 drives this first radially interior portion 432 of each blade about central axis 421. With the radially outer portion 434 of each blade 431 passing through a slot 438 in outer hub assembly 415 to the interior surface 404 of the interior chamber 403, rotation of the radially outer portion 434 of each blade 431 by the expandable working gas pushing each blade drives the outer hub assembly 415 about axis 425 and thereby rotates the inner hub 413. Namely, as the expander blades 431 rotate, successive compartments 439 of the expander containing the working gas increase in volume and thereby allow the gas to expand, and eventually exit exhaust port apertures 406 into an exhaust manifold 407 communicating with heat exchanger inlet 235 of heat exchanger 233. During rotation of the expander's outer hub assembly 415 and, consequently, its mutually geared inner hub 413, rotation of the timing gear assembly 150 drives the engine output shaft 103, producing work out for driving a load.

As described above with reference to FIG. 5, the exhaust manifold 407 of expander 120 is coupled to heat exchanger 233 at the heat exchanger exhaust gas inlet 235. Heat from the exhaust gas may be used by the heat exchanger 233 to effect a convective thermal transfer between the heat exchanger 233 and ambient air being supplied to the air inlet port of the compressor 110, thereby pre-heating intake air to the compressor 110.

For the purpose of preheating the expansion fluid that is supplied to expansion fluid passageway 412, exhaust manifold 407 contains an expansion fluid heat exchanger unit 441, which is comprised of a plurality of thermally conductive fins 443, that are attached to a meandering section of thermally conductive expansion fluid conduit or tubing 445. A first, inlet end 451 of conduit 445 is coupled to an expansion fluid inlet port 453 located at a first sidewall region 455 of exhaust manifold 407. A second outlet end 461 of expansion fluid conduit 445 is coupled to an expansion fluid outlet port 463 located at a second sidewall region 465 of exhaust manifold 407. A further section of expansion fluid tubing 471 couples port 463 with fluid inlet port 409 to fluid expansion passageway 412.

Expansion fluid heat exchanger unit 441 serves to convectively transfer heat energy in the exhaust gas from the expander 120 and preheat the expansion fluid, such as water, that is supplied at a first input temperature (e.g. nominally at 80° F.) at expansion fluid inlet port 453. For an exhaust manifold temperature on the order of 375° F., for example, the temperature of water may be preheated to a value on the order of 180° F. as it is injected at inlet port 409 of expansion fluid passageway 412.

Also diagrammatically shown in FIG. 6 is a combustor 130, which has outlet port fitting 132 joined to a combustion gas coupling port 414 of expander 120, as described above. The combustor 130 includes an outer housing wall portion 501, and an interior flame cage 503, each integrally formed with outlet port fitting 132, and defining a compressed air inlet passageway 351 of combustor 130. Combustor flame cage 503 has a plurality of openings 505 through which compressed air supplied by compressor 110, contained in passageway 351, enters the flame cage 503 and is mixed with combustion fuel injected by way of a fuel nozzle 510. Via an igniter element (not shown) the fuel/compressed air mixture is ignited to produce continuous combustion within the flame cage 503 and producing an extremely hot (e.g. on the order of 2400° F.) core within a combustion zone 514. At an end region 516 of combustion zone 514 adjacent outlet port fitting, the temperature of the combustion gas is still considerably elevated (e.g. on the order of 1800° F.).

Figure 6A:
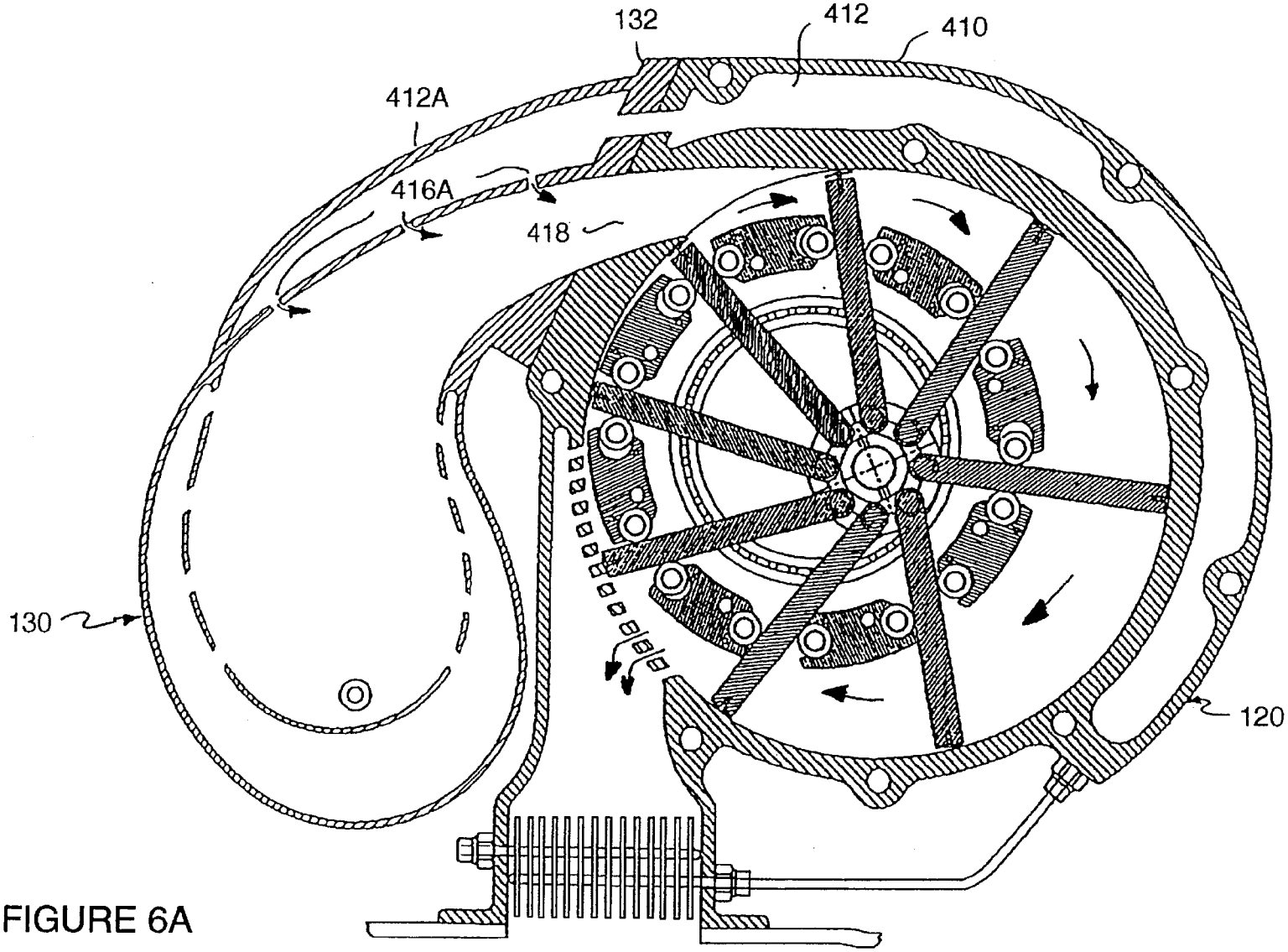
FIG. 6A shows an alternative sectional view of the expander.

FIG. 6A diagrammatically illustrates an alternative configuration of the expander—combustor arrangement of FIG. 6, wherein the outer wall portion 501 of combustor 130 may be configured to include an outer expansion fluid passageway extension chamber 412A, that is integrally joined with and forms an extension of expansion fluid passageway 412 of expander housing 410. In the embodiment of FIG. 6A, one or more apertures 416A through expansion fluid extension chamber 412A provide expansion fluid injection ports for injecting expansion fluid (steam) into the combustion gas produced by the combustor 130 and supplied to inlet throat portion 418 of the expander 120.

Figure 7:
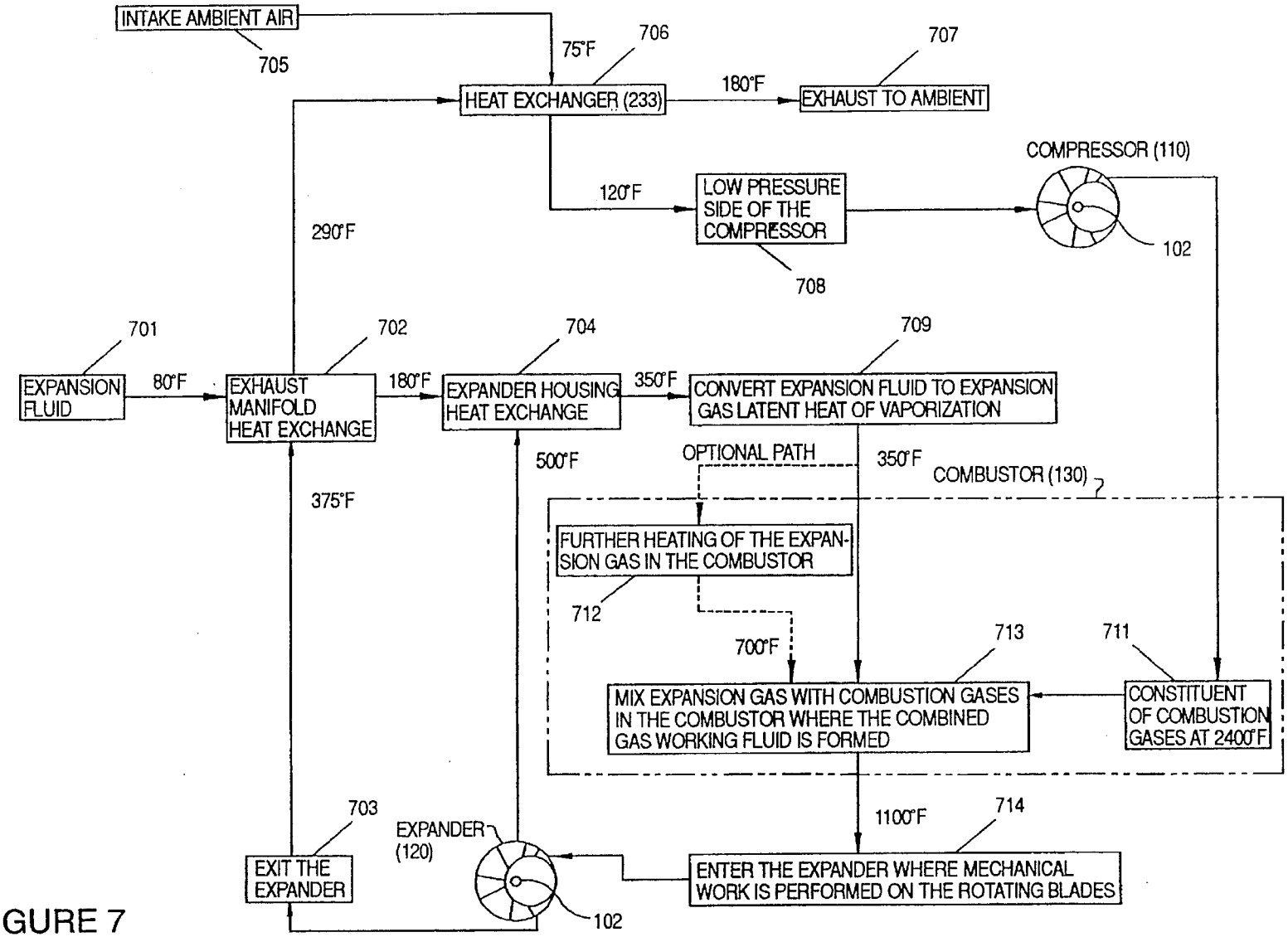
FIG. 7 is a process flow diagram illustrating the operation of the engine system according to the present invention.

The operation of the engine system described above will now be described with reference to the process flow diagram FIG. 7. At step 701, expansion fluid (e.g. water at an outside ambient temperature on the order of 80° F.) is supplied to expansion fluid inlet port 453 of exhaust manifold 407. At step 702, the expansion fluid is convectively heated (e.g. raised to a temperature on the order of 180° F.) by the transfer of heat energy in the exhaust gas (temperature on the order of 375° F.) in the exhaust manifold 407, that has entered the exhaust manifold from apertures 406 of the expander chamber 403 (step 703) of the expander 120.

At step 704, as the heating/expansion fluid travels through fluid passageway 412 surrounding the expander housing 410, which is the outer portion of interior chamber 403, the expander housing is cooled by the heat exchange between the outer wall 411 of the expander housing 410 and the expansion fluid, which operates to elevate the temperature of the expansion fluid (to a steam temperature on the order of 350° F., for example) and maintains the temperature of the housing at a relatively steady value (on the order of 500° F., for example). As shown at step 709, this thermal energy transfer effectively converts the expansion fluid in fluid passageway 412 from a liquid state to a gaseous state (e.g. steam), where the latent heat of vaporization consumes a prescribed quantity of thermal energy per unit volume of expansion fluid (per pound of water).

In the compressor 110, ambient air (e.g. at a nominal temperature of 75° F.) is supplied to the air inlet port 225, at step 705. In step 706, as air is drawn into the heat exchanger 233, it is preheated by the exhaust gas (now at a temperature on the order of 290° F.) entering the heat exchanger 233 via the exhaust manifold 407 of the expander 120. The temperature of the preheated air is now on the order of 120° F. entering the low pressure side of the compressor 110. As the exhaust gas passes through heat exchanger 233 and preheats the ambient air, there is reduction in the temperature in the exhaust gas (e.g. to a value on the order of 180° F., as the exhaust gas is exhausted at step 707 to the atmosphere through heat exchanger outlet port 245.

At step 708, the preheated air enters inlet passageway 211 of compressor 110 and is supplied therefrom via apertures 261 into the interior chamber 213 of the compressor 110. Then, as described earlier, during rotation of the compressor's inner hub 313 and associated outer hub assembly 315, pressurized pre-heated air is supplied to the compressed air inlet passageway 351 of combustor 130.

Within combustor 130, pressurized pre-heated air from the compressor 110 is supplied to the compressed air inlet passageway 351 of combustor 130. This preheated compressed air enters the flame cage 503, mixed with combustion fuel injected by way of a fuel nozzle 510, and the fuel/compressed air mixture is ignited to produce continuous combustion within the flame cage 503 and producing an extremely hot combustion temperature (e.g. on the order of 2400° F.) within combustion zone 514 of the combustor 130, as shown at step 711. At the downstream end of the combustion zone adjacent to outlet port fitting 132 and immediately upstream of throat portion 418 of the expander, the temperature of the combustion gas is still considerably elevated (e.g. on the order of 1800° F.), so that it has substantial thermal energy to be applied to the expansion fluid within the throat portion of the expander.

As the expansion fluid passes through apertures 416 in wall portion 411 of expansion fluid passageway 412 into the inlet throat portion 418 of the expander, at step 713, within inlet throat portion 418, the superheated steam mixes with combustion gases from the combustor 130, and the combined gas is injected at a substantially elevated temperature (e.g. on the order of 1100° F.) into interior chamber 403 of the expander 120.

Namely, the increase in potential energy of the expansion fluid changes its phase from a liquid phase to a gaseous phase, which is injected into the combustion gas flow path of the combustor as a steam component of the combustion gas mixture. Once it has entered the interior chamber 403 of the expander 120, the mixed gas working fluid expands during rotation of the blades of the expander (step 714). During this expansion process, the temperature of the working gas in the interior chamber of the expander drops (e.g. to about 475° F.), as work is performed and the output shaft 102 is driven. The expanded working fluid then exits to the exhaust manifold 407 at a temperature of about 375° F., as described above.

From the foregoing description of an embodiment of the present invention, it will be appreciated, that, without the cooling effect of the expansion fluid in passageway 412, the temperature of the expander housing 410 near the inlet 418 would approach the inlet temperature of the working fluid mixture, or about 1100° F. When using water as an expansion fluid, the pressure must be maintained at or above 120 psi, in order to prevent the conversion to steam. The values of 120 psi, and 350° F. are used in the present example, since they correspond to the values of pressure and temperature of water being transformed into steam. The selected combusted gas operating pressure of the system may be on the order of 115 psi, so that steam, at 120 psi, will flow into the combustion gas stream for mixing without the need for additional pumping. As higher internal system pressures are used, higher transformation temperatures are required. For example, at a pressure of 180 psi, the steam injection temperature must be increased to a value on the order of 380° F., which is the temperature at which steam turns to a gaseous phase when pressurized to 180 psi. In other words it will be appreciated that the engine housing temperatures must be higher in order to provide the necessary heating of the expansion fluid at higher operating pressures. Advantageously, the present invention is capable of successfully providing higher temperatures and pressures to accommodate improvements in the physical design of the engine system.

As discussed earlier, the invention provides for the conversion of expansion/heating fluid from a liquid state to a gaseous state (steam in the present example), where the latent heat of vaporization may consume, for example, about 870 BTU's per pound of water. Under such conditions, the amount of heat energy being extracted from the housing is maximized. A key factor is that 870 BTU's of energy are required to liberate one pound of water (or nearly equivalent expansion fluid) to steam, or a gaseous phase. The process of simply heating water consumes energy at the rate of about 1 BTU per pound of water, per degree F change in temperature. It may be readily seen that if the water were used without transformation to steam, that a much smaller percentage of energy would be transferred.

This feature of having a high temperature housing provides two key advantages. First it allows for a more efficient expansion process of the working fluid mixture in the expander housing; secondly, it allows the water to convert to steam, which consumes a much higher percentage of the housing heat or provides a much higher thermal transfer potential.

To summarize, in contrast to conventional internal combustion engine systems, where heat energy is wasted (simply being expelled to the atmosphere through a radiator), pursuant to the present invention, heat energy is transferred from the exhaust manifold and the expander housing, via the expansion fluid, at temperatures high enough to liberate the expansion fluid to a gaseous phase. The increased energy in the expansion fluid is what contributes to the increased system efficiency, and is due to the fact that the expansion fluid is later used in the engine to create (rotating) mechanical work.

The continuous combustion, pinned vane type, positive displacement, rotary compressor and expander engine system of the present invention uses an expansion fluid (water as a preferred example), to remove excess heat from an engine housing thereby controlling the operating temperature, of the housing, to within acceptable limits (500° F. for example). The expansion fluid gains energy in the form of heat from the engine housing components and is used as a working fluid in the engine system, which enables the conversion of heat energy to rotating mechanical energy in an engine system, thereby increasing the thermodynamic efficiency of the engine system for given states of temperature and pressure.

Although water has been described as one type of expansion fluid that can be used, a derivative of water or other fluid with similar characteristics may be employed. The expansion fluid may flow through a path that is in direct contact with the engine housing, as shown in FIG. 6, or it may flow through a secondary heat exchanger system, such as that illustrated in FIGS. 8–10.

Figure 8:
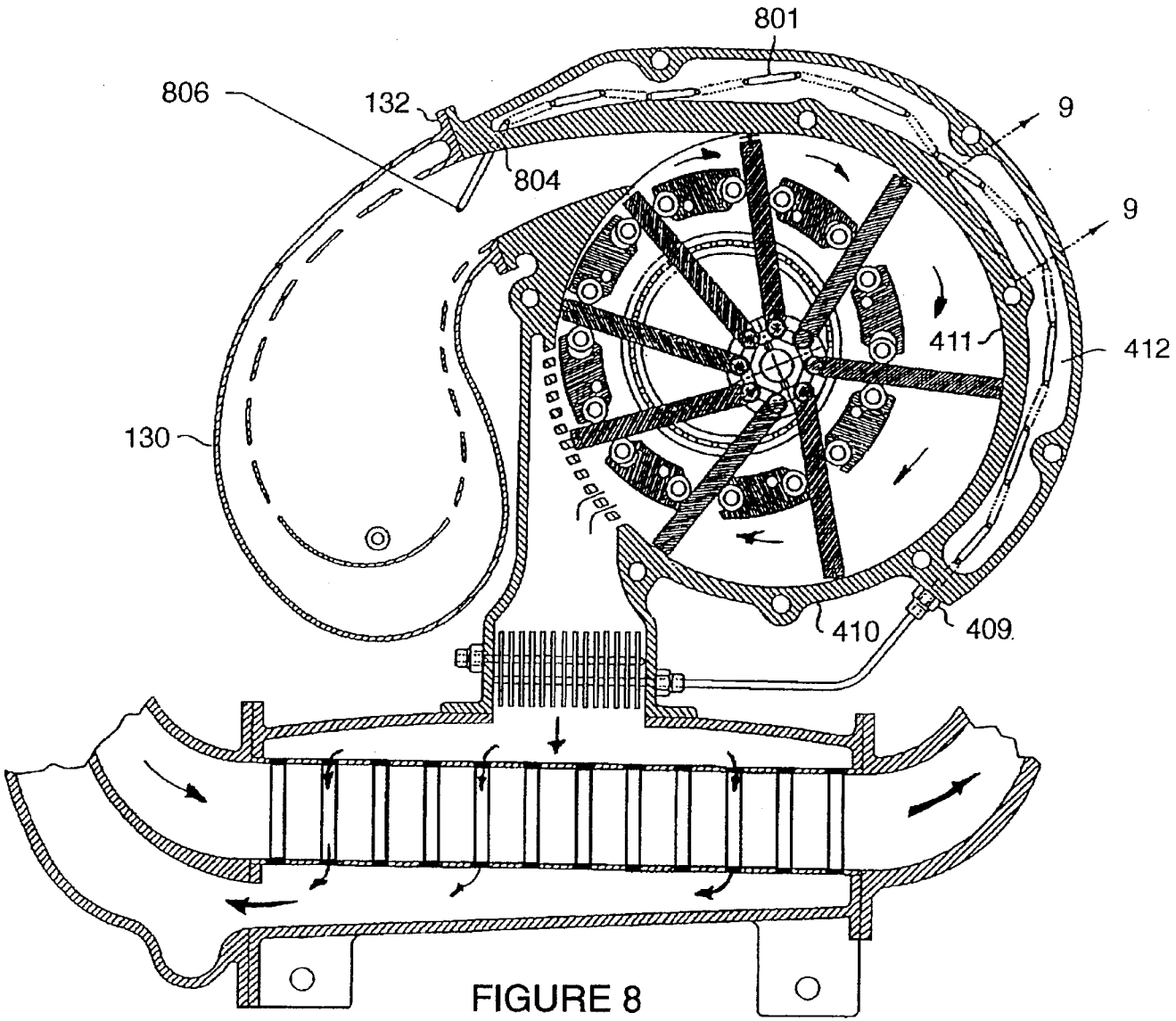
FIG. 8 shows a modification of the expander of FIG. 6, in which a section of meandering thermally conductive expansion fluid conduit extends through a heat transfer fluid passageway of the expander.
Figure 9:
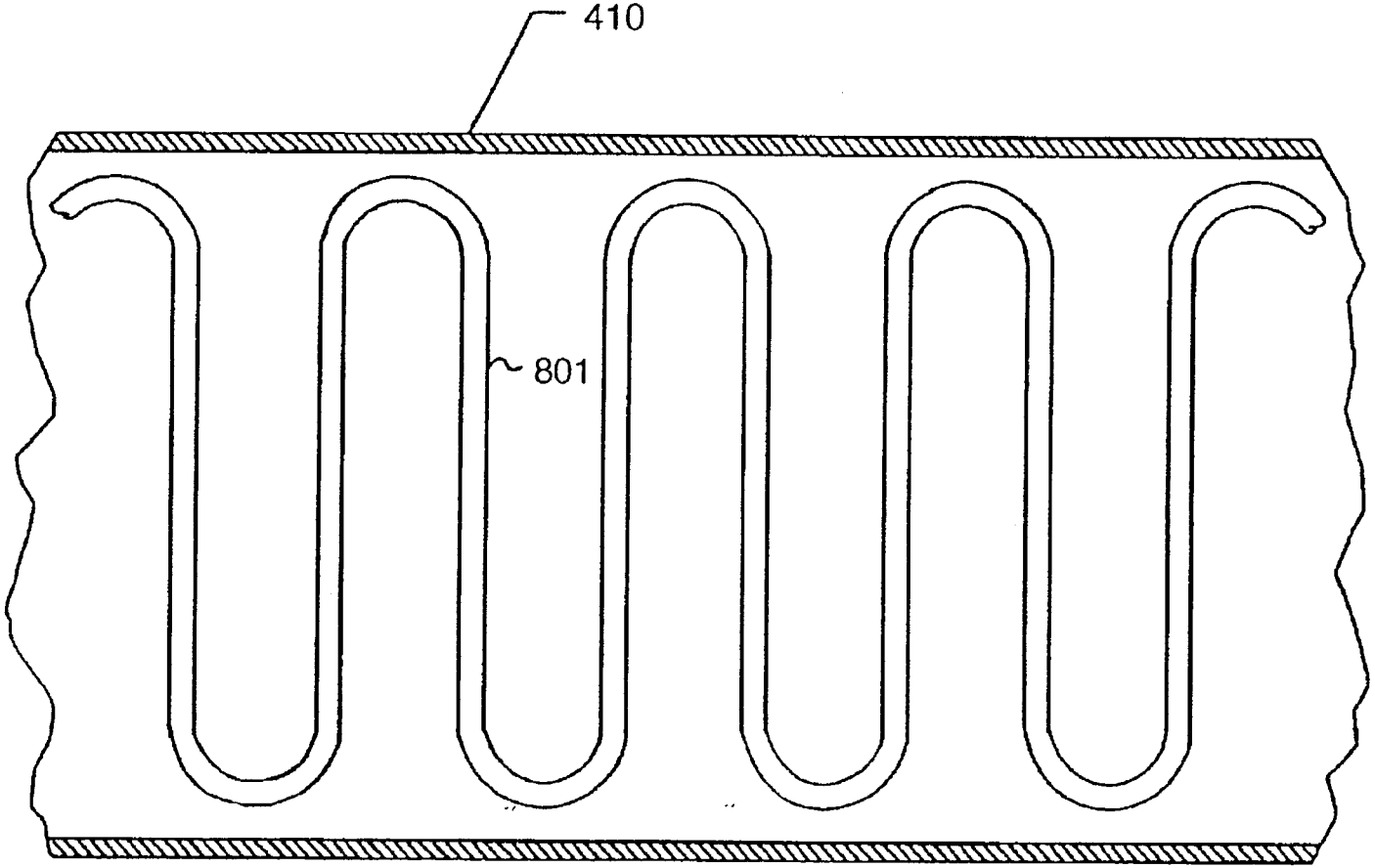
FIG. 9 is an enlarged sectional view taken along lines 9—9 of FIG. 8.

More particularly, FIG. 8 shows a modification of the expander 120 of FIG. 6, in which a section of meandering or zig-zag configured thermally conductive conduit 801, an enlarged view of a section of which taken along lines 9—9 is shown in FIG. 9, extends through expansion fluid passageway 412 of the expander housing 410. The section of expansion fluid conduit 801 extends through passageway 412 from fluid inlet port 409, passes through a bore 804 in wall 411 of housing 410 adjacent to coupling port 414 and terminates at a steam injection port 806 within that portion of the combustor 130 adjacent to its outlet port fitting 132. In this embodiment, passageway 412 is filled with a heat transfer medium, which provides an efficient thermal energy transfer flow from the thermally conductive wall 411 of the expander housing to the conduit and into the expansion fluid circulating through the conduit. The thermal energy transfer from the thermal transfer fluid in passageway 412 to the expansion fluid (e.g. water) passing through the conduit 801 causes conversion of the expansion fluid from a liquid phase to a gaseous phase by the latent heat of vaporization, so that the potential energy of the expansion fluid is raised significantly.

Figure 10:
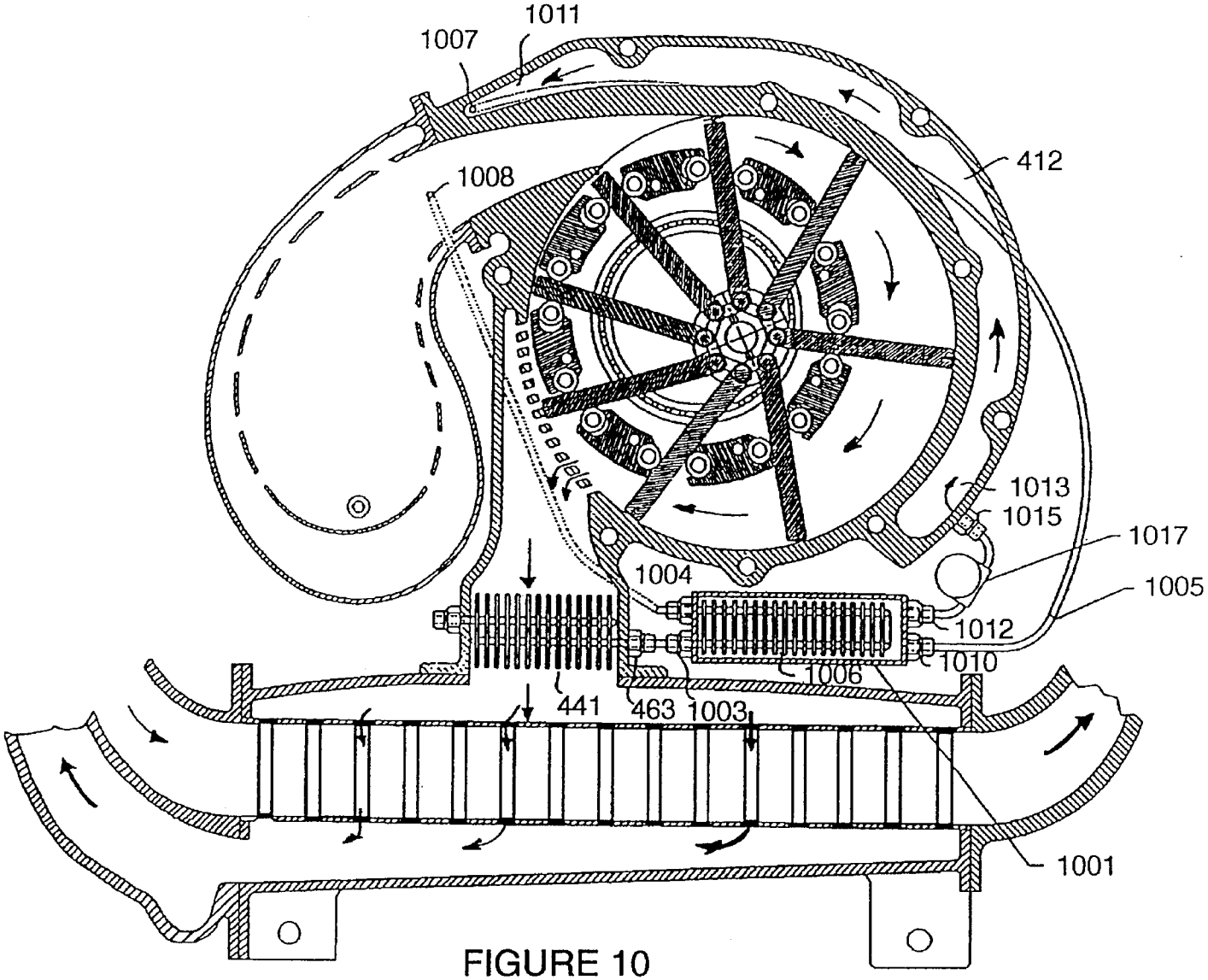
FIG. 10 shows a further modification of the expander of FIG. 6, in which a separate dual flow path heat exchanger module is coupled to respective heating fluid and expansion fluid flow paths of the expander.

FIG. 10 shows a further modification of the expander 120 of FIG. 6, in which a separate dual flow path finned heat exchanger module 1001 is coupled in the fluid flow output path of exhaust manifold heat exchanger unit 441. Specifically, heat exchanger module 1001 has a first input port 1003 which is coupled between port 463 of exhaust manifold heat exchanger unit 441 and a first output port 1004, to which an expansion fluid supply conduit 1006 is coupled. Conduit 1006 is ported at 1008 to the downstream end of combustor 130. Heat exchanger module 1001 also contains a second input port 1010, connected to heating fluid return line 1005, which is ported at 1007 to a far end portion 1011 of heating fluid passageway 412. A near end portion 1013 of fluid passageway 412 is ported at 1015 to a heating fluid pump 1017, which is coupled to a second output port 1012 of heat exchanger module 1001. The heating fluid is thus pumped in a closed system through fluid passageway 412 and return conduit 1005 through heat exchanger 1001. The expansion fluid, on the other hand is supplied through manifold heat exchanger 441 and then through heat exchanger 1001, wherein it is converted to steam by the heat transfer from the heating fluid being pumped through the heat exchanger.

In either of the above-described heat exchanger approaches of FIGS. 8–10, where the expansion fluid does not flow directly in contact with the interior surface of the passageway 412 through the expander housing 410, the passageway 412 housing is preferably filled with a high temperature, non-freezing heating fluid, such as commercially available Dow-therm. The expansion fluid may then be plumbed through the heating fluid-filled passageway 412 directly, as shown in FIG. 8, or, as described with reference to FIG. 10, it may be routed through the secondary heat exchanger 1001, through which both the heating fluid and the expansion fluid pass to provide thermal transfer.

Figure 11:
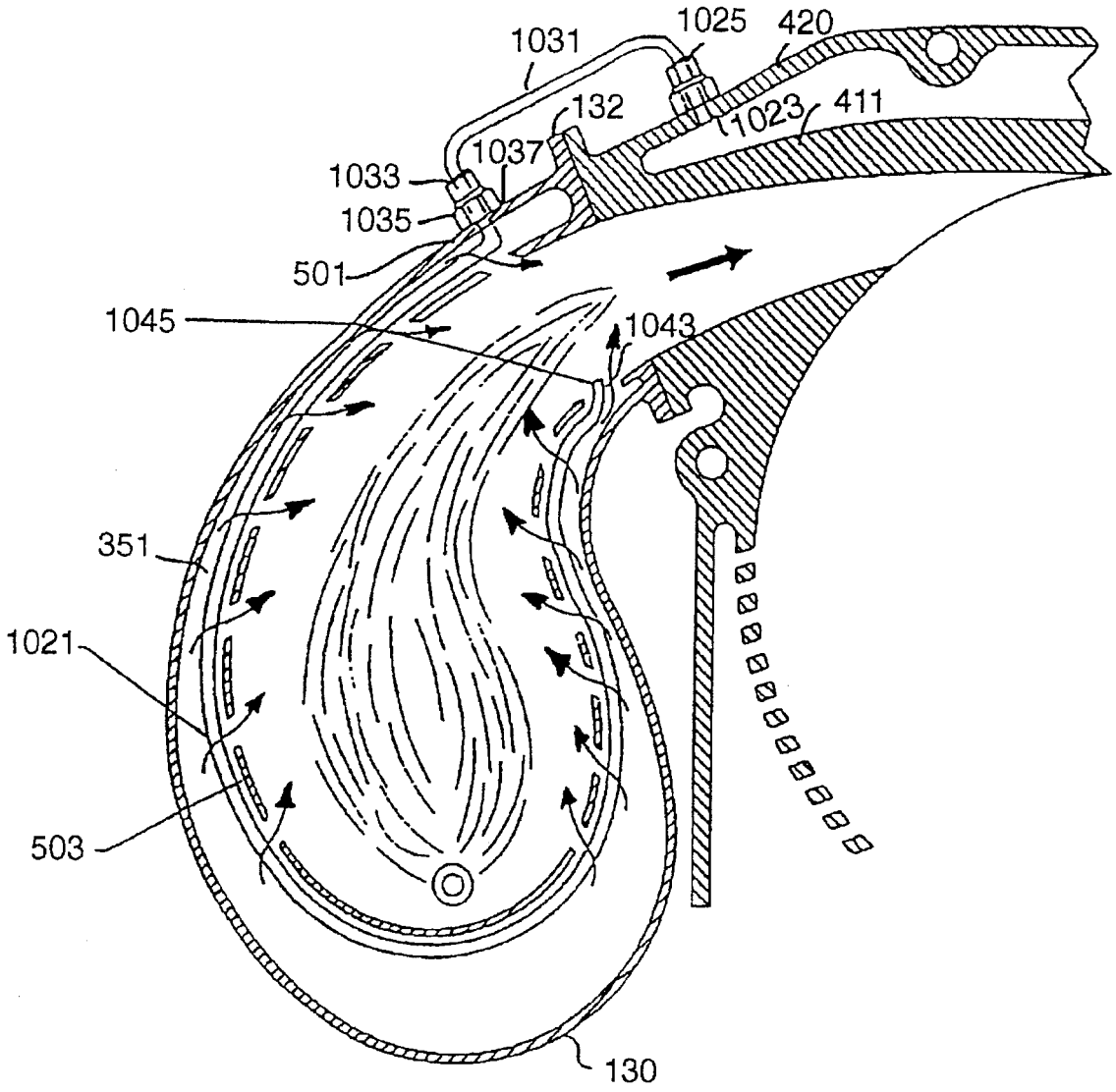
FIG. 11 shows a modification of the combustor, in which a steam supply line is routed through a passageway around the exterior perimeter of the combustor flame cage.

FIG. 11 shows a modification of the combustor 130, in which a steam supply line 1021 is routed through passageway 351 around the exterior perimeter of the combustor flame cage 503. In this configuration, rather than provide apertures as shown at 416 in FIG. 6 in wall portion 411 of the expansion fluid passageway 412 into the inlet throat to the expander 120, a bore 1023 is formed through the outer housing wall 420 and ported at 1025 to one end of a steam conduit line 1031. A second end 1033 of steam conduit line 1031 is ported at 1035 through a bore 1037 in outer housing wall portion 501 of the combustor, to a conformal section of steam tubing 1021, which is ported at terminal end 1043 to a steam injection zone 1045 at the downstream end of the combustion zone adjacent to outlet port fitting 132. Steam tubing section 1021 is used to cool the very hot section of the combustor, while absorbing additional potential energy prior to being mixed with the constituent of combustion gases in steam injection zone 1045. In this configuration, the steam temperature is increased to a value on the order of 700° F. prior to mixing, as shown at step 712 in FIG. 7.

Figure 12:
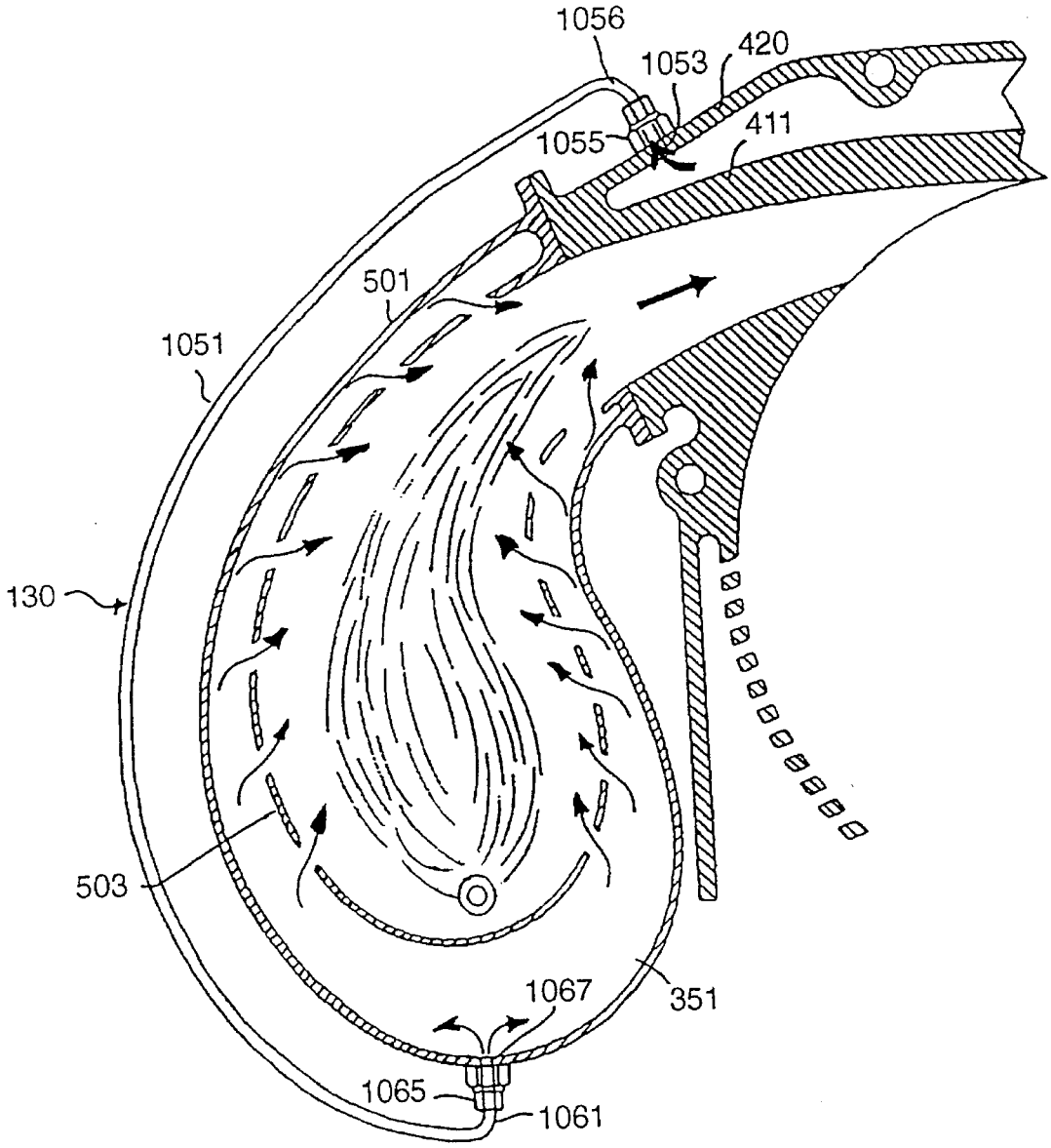
FIG. 12 shows a modification of the combustor in which steam is mixed directly with the compressed air from the compressor upstream of the combustion zone.

FIG. 12 shows a modification of the combustor 130 similar to that of FIG. 11, but in which steam is mixed directly with the compressed feed air from the compressor upstream of the combustion zone. In FIG. 12, a steam supply line 1051 is routed around the exterior perimeter of the combustor housing 501. Again, rather than provide apertures as shown at 416 in FIG. 6 in wall portion 411 of the expansion fluid passageway 412 into the inlet throat to the expander 120, a bore 1053 is formed through the outer housing wall 420 and ported at 1055 to one end 1056 of steam supply line 1051. A second end 1061 of steam supply line 1051 is ported at 1065 through a bore 1067 in outer housing wall portion 501 of the combustor, upstream of the flame cage, so that the steam mixes with the compressed air in passageway 351 prior to being injected into the flame cage 503. In this configuration, the combined gas cools the combustor and mixes with the fuel to form the products of combustion.

It should be observed that optimizing the mixing temperature of the working gas involves a number of variables which will depend upon the requirements of specific engine applications. Some of these variables include, but are not limited to, the composition of the expansion fluid, the flow rate of the expansion fluid, the exact routing of the fluid (design of the heat exchanger), and the allowable engine housing temperatures at given zones in the heat transfer path and the flame temperature at the mixing point. Combinations of the configurations previously described and referenced in FIGS. 6–12 may be used to optimize the design for various engine applications.

Consider, for purposes of illustration, a relatively simple example of how these variables react. Allowing the expansion fluid flow rate to increase results in decreasing the expander housing temperature, and as well decreases the inlet temperature of the working fluid gas mixture entering the inlet of the expander. This is based on a constant fuel flow rate. In this example the density of the working fluid performing work and the specific energy of the fluid is increased; however, because the temperature is decreased, the net energy available at the output shaft may or may not be increased. What is important is the fact that lower inlet temperatures can be incorporated into the inventive engine system without a sacrifice in net thermodynamic efficiency. The benefit of the lower inlet temperature allows for less exotic materials and manufacturing processes, and reduces the complexity of the internal cooling design of the mechanical hardware.

It should be noted that the engine system described herein operates at a considerably elevated housing temperature, when compared to a conventional internal combustion engine; however the temperature of the working fluid (expansion gas) expanding within the expander is lower than that of the expanding gas temperature in a conventional internal combustion engine. The combustion temperature of the inventive engine system is higher than that of an internal combustion engine. Examples of typical temperatures within the system are as follows:

Pinned vane expander engine housing: 500° F.

Internal combustion engine housing: 180° F.

Pinned vane expander engine working fluid: 1100° F.

Internal combustion engine working fluid: 1800° F.

Pinned vane expander engine combustion: 2400° F.

Internal combustion engine combustion: 1800° F.

Although the goal in most engine systems is to increase the working fluid temperature which, in turn, increases the theoretical efficiency, at some point the temperatures become too high to allow commercial viability based on materials and current manufacturing economics.

In the operational mode of the engine system according to the present invention, during throttling, the power out of the engine is a function of the quantity of fuel being burned. As more fuel is added the temperature is increased. With increased temperature comes increased pressure and expansion. As the combustion temperature rises, the flow rate of the expansion fluid is increased to bring the expander inlet temperature back down to its original point. As the mass flow rate of the expansion fluid increases, the power potential of the working fluid mixture increases and an increase in speed and or torque is seen at the output shaft. As the flow of fuel is decreased. The cycle works in reverse and the power at the output shaft is decreased.

Set forth below is a set of operational parameters associated with a non-limiting example illustrating the operation of the engine system according to the present invention.

| OPERATIONAL PARAMETERS | |
|---|---|
| Engine heat rate: | 245,000 BTU/hr |
| Water flow rate: | 5 gallons/hr or 0.67 lb/min |
| water inlet temperature: | 80° F. |
| Exhaust manifold heat exchanger temperature: | 375° F. |
| Water exit temperature: | 180° F. |
| Heat absorbed from exhaust manifold: | 67 BTU/min |
| Percent of net heat consumed: | 1.6% |
| Water temperature entering expander housing: | 180° F. |
| Nominal expander housing temperature: | 450° F. |
| Steam exiting expander housing: | 350° F. |
| Heat absorbed from expander housing: | 697 BTU/min |
| Percent of net heat consumed: | 17.1% |

In a conventional internal combustion engine system, assuming the same gross heat rate of 245,000 BTU's/hour, typically about 110,000 BTU's/hour would be lost through the radiator and engine case without performing mechanical work on the engine's output shaft. In accordance with the engine system of the present invention, on the other hand, on the order of 44,760 BTU's/hour are transferred from components of the engine housing to the expansion fluid for expansion in the engine. This represents a reuse of about 19 percent of the of the energy that would otherwise be wasted (released to the atmosphere) without performing work in a conventional internal combustion engine.

In the preferred embodiment of the engine system according to the present invention, as steam exits the expansion fluid passageway in the expander housing, the steam picks up an additional 13,447 BTU's/hour directly from combustion gas heat energy in the combustor. This portion of the heat transfer process represents an additional savings over a conventional internal combustion engine. Such a savings is a result of the fact that continuous combustion allows for more complete combustion, resulting in greater utilization of the fuel energy. The continuous combustion also maintains a higher continuous temperature, which contributes to more efficient heat transfer in the gas mixing process. At this point in the process, the increase in energy potential becomes twenty-four percent of the net energy consumed. This means that while a conventional internal combustion engine dissipates over fifty percent of the thermal potential energy to the atmosphere without doing work, the engine system according to the present invention can recapture twenty-four percent of the unused thermal energy for reuse.

It should also be noted that heat engines convert thermal potential energy to motion (mostly rotational). However, simply because a heat engine can convert heat to motion does not mean it can do so efficiently. In the engine system according to the present invention, the transfer of heat energy directly to rotational motion is more efficient, under the described states of temperature and pressure, than that used in the current state-of-the-art heat engine systems including turbines, piston type, and rotary (Wankel) engines. (In other words the working gas temperature and/or pressure is required to be higher.) None of these conventional physical hardware configurations performs as effectively as the continuous combustion, positive displacement, pinned vane, rotary compressor and expander engine according to the present invention.

As a further observation, except possibly for the use of one or more of extremely exotic materials, advanced internal cooling designs and high temperature lubricants, the expander of the engine system is not otherwise capable of handling the extremely hot heat energy directly associated with combustion (having a combustion core peak temperature on the order of 2400° F.). However, with the injection of steam in the heat transfer process, this extremely high temperature combustion heat energy, much of which is typically lost in other combustion engines, can be applied to the expander without damage to the expander structure. In the engine system of the present invention, 0.67 lb/minute of steam is mixed with the combustion constituents to form a higher energy working fluid (in the form of steam combustion gases). As described above, this combined fluid is then expanded in the positive displacement expander at lower temperatures, reducing the percentage of unused heat energy. This allows the engine hardware to be manufactured using lower cost materials typical of conventional engine systems.

Summarizing a number of features of the engine system according to the present invention, an expansion fluid is employed to serve the following key purposes. First the expansion fluid cools the engine, so as to control the effective operating temperature. Secondly, the expansion fluid increases the potential energy of the working fluid performing mechanical work on the rotary device blades. Third, the expansion fluid transfers heat energy from components of the engine housing to be used in the working fluid performing mechanical work on the blades.

Because the engine system according to the present invention incorporates continuous combustion, which is more efficient than independent power strokes, it is lean burning, resulting in far fewer exhaust emissions, and it has less vibration and noise than equivalently sized internal combustion engines. It will readily be appreciated that the increase in net thermodynamic efficiency provided by the present invention will greatly increase the overall commercial utility provided by the engine as compared with a conventional internal combustion engine system.

In addition to the foregoing embodiments, enhancements to the engine system described above may include configurations operating at elevated temperatures much higher than the ones described in the previous examples. In such an enhanced system, air may be used as the expansion fluid. In a very high temperature application, air may simply be pumped via the compressor of the system, through the exhaust manifold, over the expander housing, and then be mixed with the combustion gases prior to injection into the inlet port of the expander. In this case, the effectiveness of the air as a heat transfer medium is less than that of water, unless the heating temperatures are significantly elevated. This requires that the temperature differences between the air and the housing be higher, in order to transfer the same quantity of energy between the housing and the expansion fluid. As an example, the expander inlet temperature may be on the order of 1800° F. and the expander housing temperature may be on the order of 1100° F. Operation at such temperature extremes requires the use of advanced and potentially more costly materials. Still, the fundamental energy transfer mechanism of the continuous combustion, positive displacement, pinned vane, rotary compressor and expander engine according to the present invention described above is obtained.

While I have shown and described several embodiments in accordance with the present invention, it is to be understood that the same is not limited thereto but is susceptible to numerous changes and modifications as known to a person skilled in the art, and I therefore do not wish to be limited to the details shown and described herein but intend to cover all such changes and modifications as are obvious to one of ordinary skill in the art.

What is claimed:

1. A rotary expansion device comprising:

a housing having an interior gas expansion chamber surrounding a first axis and an inlet port into which an expandable working gas is introduced;

an outer hub assembly, disposed inside said gas expansion chamber and surrounding a second axis, said second axis being offset from said first axis;

an inner hub, disposed inside said outer hub assembly, and surrounding said first axis;

a plurality of blades, each of which extends radially from said inner hub and passes through said outer hub assembly to an interior surface of said gas expansion chamber, thereby forming a plurality of relatively air-tight compartments between said interior surface of said gas expansion chamber, said outer hub assembly, and respective pairs of blades, with the volume of said compartments varying as a function of rotative position about said first axis;

a linkage arrangement, which interconnects said inner hub with said outer hub exclusive of said blades, and is operative, in response to rotation of said outer hub assembly about said second axis by the expansion of said expandable working gas that has been introduced into said compartments from said inlet port, to drive said inner hub by said linkage arrangement therebetween; and a thermal transfer medium flow path having an input port to which a thermal transfer medium is supplied, and an output port coupled to combine said thermal transfer medium with a working gas introduced into said inlet port, said thermal transfer medium flow path being in thermal communication with said housing such that there is a thermal energy transfer from said housing to the thermal transfer medium within said thermal transfer medium flow path, thereby increasing the thermal energy of said thermal transfer medium that has been supplied to said input port of said thermal transfer medium flow path, and is output from said output port for combination with said working gas.

2. A rotary expansion device according to claim 1, wherein said thermal transfer medium comprises a gas.

3. A rotary expansion device according to claim 1, wherein said thermal transfer medium comprises water.

4. A rotary expansion device according to claim 1, wherein said thermal transfer medium includes steam.

5. A rotary expansion device according to claim 1, further including a combustor, having an outlet port coupled to said inlet port of said housing and being operative to supply a combusted gas thereto.

6. A rotary expansion device according to claim 5, wherein said combustor includes an outer housing portion and a flame cage disposed therein, said flame cage having a plurality of openings through which compressed air is supplied and mixed with fuel supplied to said flame cage, thereby forming a combustion mixture, which is continuously combusted in said flame cage to produce said combusted gas, said combusted gas being supplied as part of said expandable working gas to an inlet throat of said housing.

7. A rotary expansion device according to claim 5, wherein said housing has an inlet throat coupled between said interior gas expansion chamber and said combustor outlet port, and wherein said thermal transfer medium flow path has an output port coupled to said inlet throat of said housing.

8. A rotary expansion device according to claim 5, wherein said housing has an inlet throat coupled between said interior gas expansion chamber and said combustor outlet port, and wherein said thermal transfer medium flow path has an output port coupled in fluid communication with an inlet throat of said housing.

9. A rotary expansion device according to claim 5, wherein said thermal transfer medium comprises an expansion fluid and wherein said thermal transfer medium flow path comprises an expansion fluid flow path that is in direct contact with said housing.

10. A rotary expansion device according to claim 9, wherein said housing has a wall which is integral with an expansion fluid passageway forming part of said expansion fluid flow path.

11. A rotary expansion device according to claim 10, wherein said expansion fluid passageway extends to the output port of said thermal transfer medium flow path adjacent to the outlet port of said combustor.

12. A rotary expansion device according to claim 11, wherein said expansion fluid passageway has at least one aperture in fluid communication with a combustion gas flow path through the outlet port of said combustor and said inlet port of said housing.

13. A rotary expansion device according to claim 10, wherein said expansion fluid flow path includes a section of meandering thermally conductive conduit extending through said expansion fluid passageway, said section of meandering thermally conductive conduit passing through a bore in said housing and providing an expansion fluid injection port in a combustion gas flow path from the output of said combustor to the inlet port of said housing.

14. A rotary expansion device according to claim 5, wherein said thermal transfer medium comprises an expansion fluid and wherein said thermal transfer medium flow path comprises a heat exchanger separate from said engine housing, wherein expansion fluid is heated and provided to an inlet throat of the expansion device housing.

15. A rotary expansion device according to claim 14, further including an exhaust manifold coupled to provide a working gas exhaust path for removing exhaust gas from said housing, and wherein an expansion fluid heat exchanger is coupled with said exhaust manifold.

16. A rotary expansion device according to claim 15, wherein said heat exchanger is coupled with a heating fluid return line ported to a first portion of said expansion fluid passageway, a second portion of which is ported to a heating fluid pump, which is coupled to pump heating fluid through said expansion fluid passageway to said heat exchanger, so that said heating fluid may be pumped in a closed system through the expansion fluid passageway and said heating fluid return line to said heat exchanger, and wherein said expansion fluid is supplied through said heat exchanger, so that its thermal energy is raised by heat transfer from both the expansion gas in the exhaust manifold and said heating fluid pumped through said heat exchanger.

17. A rotary expansion device according to claim 5, further comprising a compressor coupled to supply compressed air to said combustor.

18. A rotary expansion device according to claim 17, wherein said combustor includes an outer housing portion and a flame cage disposed therein, said flame cage having a plurality of openings through which compressed air from said compressor is supplied and mixed with fuel supplied to said flame cage, thereby forming a combustion mixture, which is continuously combusted in said flame cage to produce said combusted gas, said combusted gas being supplied as part of said expandable working gas to said inlet port of said housing.

19. A rotary expansion device according to claim 18, wherein said thermal transfer medium flow path is routed around a perimeter of said outer housing portion of said combustor and coupled through an aperture in said outer housing portion of said combustor, upstream of the flame cage, so that said expansion fluid medium mixes with compressed air prior to being supplied into said flame cage.

20. A rotary expansion device according to claim 14, wherein an expansion fluid flow path is provided through an exhaust gas manifold heat exchanger and around an expansion fluid passageway, and is injected into a combustible gas inlet throat of said expansion device housing.

21. A rotary expansion device according to claim 18, wherein said thermal transfer medium flow path is routed through a passageway around said flame cage to a thermal medium injection zone downstream of where combustion occurs in said flame cage, so that said thermal transfer medium may cool a high temperature section of said combustor, while absorbing additional potential energy prior to being mixed with combusted gas.

22. A rotary expansion device according to claim 5, wherein said combustor is operative to heat said thermal transfer medium which is mixed with said combusted gas before being provided as said expandable working gas to said inlet port of said housing.

23. A rotary expansion device according to claim 22, wherein said thermal transfer medium contains steam.

24. A rotary expansion device according to claim 1, wherein said expandable working fluid contains a combustion gas and steam.

25. A rotary expansion device according to claim 1, wherein said linkage arrangement comprises a set of gears which is arranged so as to cause said inner hub to rotate one revolution about said first axis for everyone rotation of said outer hub assembly about said second axis.

26. A rotary expansion device according to claim 1, wherein said thermal transfer medium is comprised of water and at least one additional substance.

27. A rotary expansion device according to claim 20, wherein said expansion fluid flow path comprises a steam supply line, which is routed through a compressed air supply passageway surrounding said combustor flame cage.

28. An engine system comprising a housing containing a compressor which is operative to output compressed air, a combustor which is operative to effect continuous combustion of a combustion gas mixture containing fuel and said compressed air and produce a combustion gas output, and an expander to which a mixture of said combustion gas and an expansion fluid is supplied as an expandable working gas, said expander being operative to expand said expandable working gas and perform work which causes rotation of an engine output shaft, each of said compressor and said expander comprising a respective pinned vane type, positive displacement, rotary device, and wherein said engine system further includes an expansion fluid flow path having an input port to which said expansion fluid is supplied, and an output port coupled to combine said expansion fluid with said combustion gas as said expandable working gas, said expansion fluid flow path being in thermal communication with said housing such that there is a thermal energy transfer from said housing to said expansion fluid, thereby increasing the thermal energy of said expansion fluid that has been supplied to said input port of said expansion fluid flow path, and is output from said output port for combination with said combustion gas as said expandable working gas.

29. An engine system according to claim 28, wherein said expansion fluid comprises a gas.

30. An engine system according to claim 28, wherein said expansion fluid contains water or steam.

31. An engine system according to claim 28, wherein said expansion fluid flow path passes through said combustor so as to cause additional heat energy to be added to said expansion fluid as it passes through said combustor, thereby cooling said combustor and increasing the potential energy of said expansion fluid.

32. An engine system according to claim 31, wherein said expansion fluid has a flow rate through said expansion fluid flow path which is controlled so that the temperature of said expandable working gas being supplied to said expander is controllably regulated under a constant fuel flow rate, whereby as the mass flow rate of said expansion fluid increases, the temperature of said expandable working gas being supplied to said expander decreases, and as the mass flow rate of said expansion fluid decreases, then the temperature of said expandable working gas being supplied to said expander increases.

33. An engine system according to claim 28, wherein said expansion fluid flow path is in direct contact with said engine housing.

34. An engine system according to claim 33, wherein said housing has a wall which is integral with an expansion fluid passageway forming part of said expansion fluid flow path.

35. An engine system according to claim 34, wherein said expansion fluid passageway passageway has at least one aperture in fluid communication with a combustion gas flow path through the outlet port of said combustor and said inlet port of said housing.

36. An engine system according to claim 34, wherein said expansion fluid flow path includes a section of meandering thermally conductive conduit extending through said expansion fluid passageway, said section of meandering thermally conductive conduit passing through a bore in said housing and providing an expansion fluid injection port in a combustion gas flow path from the output of said combustor to the inlet port of said housing.

37. An engine system according to claim 28, wherein said expansion fluid flow path contains a heat exchanger separate from said engine housing.

38. An engine system according to claim 37, wherein said expander includes an exhaust manifold coupled to provide a working gas exhaust path for removing exhaust gas from said housing, and wherein said heat exchanger is coupled with said exhaust manifold.

39. An engine system according to claim 38, wherein said heat exchanger is coupled with a heating fluid return line ported to a first portion of said expansion fluid passageway, a second portion of which is ported to a heating fluid pump, which is coupled to pump heating fluid through said expansion fluid passageway to said heat exchanger, so that heating fluid may be pumped in a closed system through the expansion fluid passageway and said heating fluid return line to said heat exchanger, and wherein said expansion fluid is supplied through said heat exchanger, so that its thermal energy is raised by heat transfer from said heating fluid pumped through said heat exchanger.

40. An engine system according to claim 28, wherein said combustor includes an outer housing portion and a flame cage disposed therein, said flame cage having a plurality of openings through which compressed air from said compressor is supplied and mixed with fuel supplied to said flame cage, thereby forming a combustion mixture, which is continuously combusted in said flame cage to produce said combusted gas, said combusted gas being supplied as part of said expandable working gas to said inlet port of the housing of said expander.

41. An engine system according to claim 40, wherein said expansion fluid flow path is routed around a perimeter of said outer housing portion of said combustor and coupled through an aperture in said outer housing portion of said combustor, upstream of the flame cage, so that said expansion fluid mixes with compressed air prior to being supplied into said flame cage.

42. An engine system according to claim 40, wherein said expansion fluid flow path is routed through a passageway around said flame cage to an expansion fluid injection zone downstream of where combustion occurs in said flame cage, so that said expansion fluid may cool a high temperature section of said combustor, while absorbing additional potential energy prior to being mixed with combusted gas.

43. An engine system according to claim 42, wherein said expansion fluid flow path comprises a steam supply line, which is routed through a compressed air supply passageway surrounding said combustor flame cage.

44. An engine system according to claim 42, wherein said expansion fluid flow path comprises a steam supply line, which is routed through said compressed air supply passageway surrounding said combustor flame cage and is ported through openings into an inlet throat of said housing.

45. An engine system according to claim 28, wherein said expansion fluid comprises a liquid having increased potential energy, which, upon changing phase to a gaseous phase is injected into the combustion gas flow path of said combustor as steam component of said expandable working gas, and is allowed to expand with constituents of a combusted gas mixture in said expander, thereby performing mechanical work, which causes rotation of said output shaft.

46. An engine system according to claim 28, wherein said expansion fluid comprises a liquid having increased potential energy, which, upon changing phase to a gaseous phase is injected into the combustion gas flow path of said combustor as steam component of said expandable working gas, and is allowed to expand with constituents of a combusted gas mixture in said expander, thereby performing mechanical work, which causes rotation of said output shaft, and wherein that portion of said expansion fluid which is still in a liquid phase is also injected into said combustion gas and transitions to a gas phase when mixing with said combustion gas.

47. A method of controlling the operation of an engine system having a compressor which is operative to output compressed air, a combustor which is operative to effect continuous combustion of a combustion gas mixture containing fuel and said compressed air and produce a combustion gas output, and an expander to which a mixture of said combustion gas and an expansion fluid is supplied as an expandable working gas, said expander being operative to expand said expandable working gas and perform work which causes rotation of an engine output shaft, each of said compressor and said expander comprising a respective pinned vane type, positive displacement, rotary device, comprising the steps of:

(a) coupling an expansion fluid flow path in thermal communication with a housing of said expander rotary device, so that thermal energy within the housing of said expander rotary device is coupled to said expansion fluid flow path, said expansion fluid flow path having an output port coupled in fluid communication with combustion gas of said combustor; and (b) controllably causing expansion fluid to flow through said expansion fluid flow path to be combined with said combustion gas as said expandable working gas, such that there is a thermal energy transfer from said housing to said expansion fluid, thereby causing said expansion fluid to absorb thermal energy from the expander housing, and increasing the thermal energy of said expansion fluid that has been supplied to said expansion fluid flow path, and is combined with combustion gas to form said expandable working gas.

48. A method according to claim 47, wherein said housing of said expander rotary device is configured to form a portion of said expansion fluid flow path, which extends to a coupling port to which a combustion gas output of said combustor is coupled, so that during step (b), said housing serves to raise the temperature of said expansion fluid that has been injected into said expansion fluid flow path, as said expansion fluid travels and is conductively heated by the elevated temperature of said expander housing, whereby said expander housing is cooled by thermal exchange with said expansion fluid, which operates to maintain the temperature of the housing at a relatively steady value.

49. A method according to claim 47, wherein said expansion fluid comprises a gas.

50. A method according to claim 47, wherein said expansion fluid comprises at least one of water and steam.

51. A method according to claim 47, wherein said expansion fluid flow path passes through said combustor so as to cause additional heat energy to be added to said expansion fluid as it passes through said combustor, thereby cooling said combustor and increasing the potential energy of said expansion fluid.

52. A method according to claim 51, wherein step (b) comprises controlling the flow rate of said expansion fluid through said expansion fluid flow path so that the temperature of said expandable working gas being supplied to said expander is controllably regulated, whereby as the mass flow rate of said expansion fluid increases, the temperature of said expandable working gas being supplied to said expander decreases, and as the mass flow rate of said expansion fluid decreases, then the temperature of said expandable working gas being supplied to said expander increases.

53. A method according to claim 47, wherein step (a) comprises providing said expansion fluid flow path in direct contact with said expander rotary device housing.

54. A method according to claim 53, wherein step (a) comprises porting said expansion fluid passageway at a location adjacent to a combustion gas output port of said combustor, so that said expansion fluid mixes with said combustion gas to form said expandable working gas.

55. A method according to claim 47, wherein step (a) comprises coupling said expansion fluid passageway through an expansion exhaust gas heat exchanger.

56. A method according to claim 54, wherein step (a) comprises extending a section of meandering thermally conductive conduit extending through said expansion fluid passageway, so that said section of meandering thermally conductive conduit passes through a bore in said housing and providing an expansion fluid injection port in a combustion gas flow path from the output of said combustor to the inlet port of said housing.

57. A method according to claim 56, wherein said expansion fluid flow path contains a heat exchanger separate from said housing.

58. A method according to claim 47, wherein said combustor includes an outer housing portion and a flame cage disposed therein, said flame cage having a plurality of openings through which compressed air from said compressor is supplied and mixed with fuel supplied to said flame cage, thereby forming a combustion mixture, which is continuously combusted in said flame cage to produce said combusted gas, said combusted gas being supplied as part of said expandable working gas to said inlet port of the housing of said expander.

59. A method according to claim 58, wherein step (a) comprises routing said expansion fluid flow path around a perimeter of said outer housing portion of said combustor and coupled through an aperture in said outer housing portion of said combustor, upstream of the flame cage, so that said expansion fluid mixes with compressed air prior to being supplied into said flame cage.

60. A method according to claim 58, wherein step (a) comprises routing said expansion fluid flow path through a passageway around said flame cage to an expansion fluid injection zone downstream of where combustion occurs in said flame cage, so that said expansion fluid may cool a high temperature section of said combustor, while absorbing additional potential energy prior to being mixed with combusted gas.

61. A method according to claim 60, wherein step (a) comprises routing a steam supply line through a compressed air supply passageway surrounding said combustor flame cage.

62. A method according to claim 47, wherein said expansion fluid comprises a liquid having increased potential energy, which is injected into said combustion gas output at a combustor outlet prior to being liberated into a gaseous phase as a component of said expandable working gas, so that said gaseous phase expansion fluid is allowed to expand in said expander, thereby performing mechanical work, which causes rotation of said engine output shaft.

63. A method according to claim 47, wherein a portion of said expansion fluid comprises a liquid having increased potential energy, which is injected into said combustion gas output at a combustor outlet prior to being liberated into a gaseous phase as a component of said expandable working gas, so that said gaseous phase expansion fluid is allowed to expand in said expander, thereby performing mechanical work, which causes rotation of said output shaft.

* * * * *